US008971157B2

(12) United States Patent
Saito

(10) Patent No.: US 8,971,157 B2
(45) Date of Patent: Mar. 3, 2015

(54) DISPLAY APPARATUS AND ELECTRONIC DEVICE

(71) Applicant: Casio Computer Co., Ltd., Shibuya-ku, Tokyo (JP)

(72) Inventor: Yuta Saito, Kokubunji (JP)

(73) Assignee: Casio Computer Co., Ltd., Tokyo (JP)

( * ) Notice: Subject to any disclaimer, the term of this patent is extended or adjusted under 35 U.S.C. 154(b) by 6 days.

(21) Appl. No.: 13/759,705

(22) Filed: Feb. 5, 2013

(65) Prior Publication Data

US 2013/0208574 A1 Aug. 15, 2013

(30) Foreign Application Priority Data

Feb. 15, 2012 (JP) ..... 2012-030616

(51) Int. Cl.

| | |
|---|---|
| ***G04B 19/02*** | (2006.01) |
| ***G04B 27/00*** | (2006.01) |
| ***G04B 19/20*** | (2006.01) |
| ***G04B 19/247*** | (2006.01) |
| ***G04C 17/00*** | (2006.01) |

(52) U.S. Cl.

CPC ..... *G04B 19/202* (2013.01); *G04B 19/247* (2013.01); *G04C 17/0066* (2013.01)

USPC ..... 368/221; 368/220; 368/222; 368/35; 368/77

(58) Field of Classification Search

CPC .. G04C 17/005; G04C 17/0058; G04B 19/25; G04B 19/046; G04B 19/20; G04B 19/202

USPC ..... 368/28, 35–37, 76, 77, 220, 221, 232, 368/233

See application file for complete search history.

(56) References Cited

U.S. PATENT DOCUMENTS

| | | | | |
|---|---|---|---|---|
| 4,276,628 | A | 6/1981 | Nomura | |
| 5,319,617 | A * | 6/1994 | Sonoda | 368/294 |
| 6,894,952 | B2 | 5/2005 | Morokawa et al. | |
| 2004/0062147 | A1 * | 4/2004 | Morokawa et al. | 368/80 |
| 2006/0002237 | A1 * | 1/2006 | Takahashi | 368/28 |

(Continued)

FOREIGN PATENT DOCUMENTS

| | | |
|---|---|---|
| JP | 54-024674 A | 2/1979 |
| JP | 61-032390 Y2 | 9/1986 |

(Continued)

OTHER PUBLICATIONS

Japanese Office Action dated Dec. 24, 2013 (and English translation thereof) in counterpart Japanese Application No. 2012-030616.

*Primary Examiner* — Amy Cohen Johnson
*Assistant Examiner* — Daniel Wicklund
(74) *Attorney, Agent, or Firm* — Holtz, Holtz, Goodman & Chick PC

(57) ABSTRACT

A display apparatus which includes: a first display wheel that has a first display section; a second display wheel that has a second display section; a driving section that rotates in a forward direction and a reverse direction, and rotates the first display wheel in the forward direction and the reverse direction; and a rotating section that rotates only the first display wheel in the forward direction when the first display wheel is rotated in the forward direction, and rotates the second display wheel in the reverse direction together with the first display wheel when the first display wheel is rotated in the reverse direction.

19 Claims, 35 Drawing Sheets

(56) References Cited

U.S. PATENT DOCUMENTS

| | | | | |
|---|---|---|---|---|
| 2007/0047391 | A1* | 3/2007 | Suzuki et al. | 368/37 |
| 2007/0177464 | A1* | 8/2007 | Watanabe | 368/37 |

FOREIGN PATENT DOCUMENTS

| | | | |
|---|---|---|---|
| JP | 62-058789 | U | 4/1987 |
| WO | WO 02/39197 | A1 | 5/2002 |

* cited by examiner

DISPLAY APPARATUS AND ELECTRONIC DEVICE

CROSS-REFERENCE TO RELATED APPLICATION

This application is based upon and claims the benefit of priority from the prior Japanese Patent Application No. 2012-030616, filed Feb. 15, 2012, the entire contents of which is incorporated herein by reference.

BACKGROUND OF THE INVENTION

1. Field of the Invention

The present invention relates to a display apparatus used in a device, such as a timepiece and calendar apparatus or an instrument meter, and an electronic device equipped with the display apparatus.

2. Description of the Related Art

For example, as described in Japanese Patent Application Laid-Open (Kokai) Publication No. 54-024674 (corresponding to U.S. Pat. No. 4,276,628), an electronic watch is known. In this watch, when a motor serving as a driving section rotates in the forward direction, a date wheel and a month wheel are not rotated even when a time gear train rotates in the forward direction and moves the hands. When the motor rotates in the reverse direction, the date wheel and the month wheel are rotated via the time gear train, whereby date and month displays are changed and updated.

In this type of display apparatus of an electronic watch, dates, from the 1st to the 31st, are displayed on the date wheel. Therefore, when the 31st day is displayed at the end of the "small month" (consisting of 30 days, i.e., smaller by one day than 31 days) the 31st day needs to be detected by a calendar detector mechanism, whereby a control circuit controls so that the date is changed once more by feeding the date wheel. Thus, the display apparatus of the electronic watch includes a restricting lever that restricts the rotation of the month wheel, a conductive pin that is provided in a position where the date wheel displays the 31st, and a switch spring that has an insulated portion and comes in and out of contact with the conductive pin. As a result of this configuration, the 31st day which should not be included in the small month is detected.

In this type of display apparatus of an electronic watch, when the month wheel displays "large month" (consisting of 31 days), the restricting lever outwardly pushes up the insulated portion of the switch spring, whereby the switch spring does not come in contact with the conductive pin. When the month wheel displays a "small month", the restricting lever does not push the insulated portion of the switch spring, whereby the switch spring comes in contact with the conductive pin. As a result, the 31st day which should not be included in the small month is detected.

However, to detect the 31st day which should not be included in the small month, this type of display apparatus for an electronic watch requires various components, such as the restricting lever that restricts the rotation of the month wheel, the conductive pin that is provided in the position where the date wheel displays the 31st, and the switch spring that has the insulated portion and comes in and out of contact with the conductive pin. As a result, the large number of components makes the display apparatus complicated to assemble and easily leads to malfunctions.

An object of the present invention is to provide a display apparatus having a simple structure that can easily and appropriately change a plurality of displays by forward rotation and reverse rotation of a driving section, and an electronic device including the display apparatus.

SUMMARY OF THE INVENTION

In order to achieve the above-described object, in accordance with one aspect of the invention, there is provided a display apparatus includes: a first display wheel which has a first display section; a second display wheel which has a second display section; a driving section which rotates in a forward direction and a reverse direction, and rotates the first display wheel in the forward direction and the reverse direction; and a rotating section which rotates only the first display wheel in the forward direction when the first display wheel is rotated in the forward direction, and rotates the second display wheel in the reverse direction together with the first display wheel when the first display wheel is rotated in the reverse direction.

The above and further objects and novel features of the present invention will more fully appear from the following detailed description when the same is read in conjunction with the accompanying drawings. It is to be expressly understood, however, that the drawings are for the purpose of illustration only and are not intended as a definition of the limits of the invention.

BRIEF DESCRIPTION OF THE DRAWINGS

FIG. 4A and FIG. 4B are diagrams of a first display wheel of the calendar mechanism section shown in FIG. 2, in which FIG. 4A is an enlarged front view thereof and FIG. 4B is an enlarged cross-sectional view thereof taken along line B-B;

FIG. 5A, FIG. 5B, and FIG. 5C are diagrams of a second display wheel of the calendar mechanism section shown in FIG. 2, in which FIG. 5A is an enlarged front view thereof, FIG. 5B is an enlarged cross-sectional view thereof taken along line C-C, and FIG. 5C is an enlarged cross-sectional view of main sections thereof taken along line D-D;

FIG. 6A and FIG. 6B are diagrams of a brake member of the calendar mechanism section shown in FIG. 3, in which FIG. 6A is an enlarged front view thereof and FIG. 6B is an enlarged cross-sectional view of main sections thereof taken along line E-E;

FIG. 9A, FIG. 9B, and FIG. 9C are diagrams of a correspondence relationship between a sloped recessing section of the second display wheel and a flat spring section of the brake member shown in FIG. 3, in which FIG. 9A is an enlarged cross-sectional view of main sections in a state where the flat spring section of the brake member is engaged with the sloped recessing section of the second display wheel, FIG. 9B is an enlarged cross-sectional view of main sections in a state where, when the second display wheel idles, the flat spring section of the brake member is engaged with the sloped recessing section of the second display wheel and then pressed downward, thereby being resiliently deformed, and FIG. 9C is an enlarged cross-sectional view of main sections in a state where, when the second display wheel rotates in response to the reverse rotation of the first display wheel, the flat spring section of the brake member is disengaged from the sloped recessing section of the second display wheel;

FIG. 10A, FIG. 10B and FIG. 10C, are diagrams of the calendar mechanism section shown in FIG. 2 showing operating states of a portion where the first clutch teeth of the first display wheel and the second clutch teeth of the second display wheel become unmeshed when the first display wheel rotates in the forward direction, in which FIG. 10A is an enlarged front view of main sections when the first display wheel rotates in the forward direction, FIG. 10B is an enlarged cross-sectional view of main sections in a state where the first clutch teeth and the second clutch teeth slide against each other and whereby the second display wheel idles, and FIG. 10C is an enlarged cross-sectional view of main sections in a state where the flat spring section of the brake member is engaged with the sloped recessing section of the second display wheel and then pressed downward, thereby being resiliently deformed;

FIG. 11A, FIG. 11B, and FIG. 11C are diagrams of the calendar mechanism section shown in FIG. 2 showing operating states of a portion where the first clutch teeth of the first display wheel and the second clutch teeth of the second display wheel are meshed when the first display wheel rotates in the reverse direction, in which FIG. 11A is an enlarged front view of main sections when the first display wheel 5 rotates in the reverse direction, FIG. 11B is an enlarged cross-sectional view of main sections in a state where the first clutch teeth and the second clutch teeth are meshed and the second display wheel is rotated together with the first display wheel, and FIG. 11C is an enlarged cross-sectional view of main sections in a state where the fiat spring section of the brake member is disengaged from the sloped recessing section of the second display wheel in response to the rotation of the second display wheel;

FIG. 15A, FIG. 15B, and FIG. 15C are diagrams of date changing states at the end of the month in the date change processing shown in FIG. 14, in which FIG. 15A is a diagram of a date display state at 23:59:50 at the end of the month, FIG. 15B is a diagram of a state where the first display wheel rotates in the reverse direction from the display state shown in FIG. 15A and whereby display of a second digit is changed from the date display state shown in FIG. 15A to the display state shown as a second digit of the following day, and FIG. 15C is a diagram of a state where the first display wheel rotates in the forward direction from the display state shown in FIG. 15B and whereby display of a first digit is changed from the date display state shown in FIG. 15B to the display state shown as a first digit of the following day and whereby the date is updated;

FIG. 18A, FIG. 18B, and FIG. 18C are diagrams of a portion where first clutch teeth of a first display wheel and second clutch teeth of a second display wheel are meshed in the calendar mechanism section shown in FIG. 16, in which FIG. 18A is an enlarged front view of main sections thereof 18B is an enlarged cross-sectional view of main sections taken along line H-H, and FIG. 18C is an enlarged cross-sectional view of main sections showing an engaging state where a sloped recessing section of the second display wheel and a flat spring section of a brake member engage;

FIG. 19A, FIG. 19B, and FIG. 19C are diagrams of the calendar mechanism section shown in FIG. 18A, FIG. 18B, and FIG. 18C, showing operating states of a portion where the first clutch teeth of the first display wheel and the second clutch teeth of the second display wheel become unmeshed when the first display wheel rotates in the forward direction, in which FIG. 19A is an enlarged front view of main sections when the first display wheel rotates in the forward direction, FIG. 19B is an enlarged cross-sectional view of main sections in a state where the first clutch teeth and the second clutch teeth slide against each other and whereby the second display wheel idles, and FIG. 19C is an enlarged cross-sectional view of main sections in a state where the flat spring section of the brake member is engaged with the sloped recessing section of the second display wheel and then pressed downward, thereby being resiliently deformed;

FIG. 20A, FIG. 20B, and FIG. 20C are diagrams of the calendar mechanism section shown in FIG. 18A, FIG. 18B, and FIG. 18C, showing operating states of a portion where the first clutch teeth of the first display wheel and the second clutch teeth of the second display wheel are meshed when the first display wheel rotates in the reverse direction, in which FIG. 20A is an enlarged front view of main sections when the first display wheel 5 rotates in the reverse direction, FIG. 20B is an enlarged cross-sectional view of main sections in a state where the first clutch teeth and the second clutch teeth are meshed and the second display wheel rotates together with the first display wheel, and FIG. 20C is an enlarged cross-sectional view of main sections in a state where the flat spring section of the brake member is disengaged from the sloped recessing section of the second display wheel in response to the rotation of the second display wheel;

FIG. 24A and FIG. 24B are diagrams of braking states where the brake member of the calendar mechanism section shown in FIG. 21 applies a brake on the rotation of a second display wheel, in which FIG. 24A is an enlarged front view of main sections in a state where second saw teeth of the second display wheel are meshed with first saw teeth of the brake member, and the position of the second display wheel is restricted, and whereby the second display wheel idles when a first display wheel rotates in the forward direction, and FIG. 24B is an enlarged front view of the main sections in a state where the meshing between the second saw teeth of the second display wheel and the first saw teeth of the brake member becomes unmeshed, and whereby the second display wheel is rotated together with the first display wheel when the first display wheel rotates in the reverse direction;

DETAILED DESCRIPTION OF THE PREFERRED EMBODIMENTS (First Embodiment)

A first embodiment in which the present invention has been applied to a pointer type electronic wristwatch will hereinafter be described with reference to FIG. 1 to FIG. 15A, FIG. 15B, and FIG. 15C.

Figure 1:
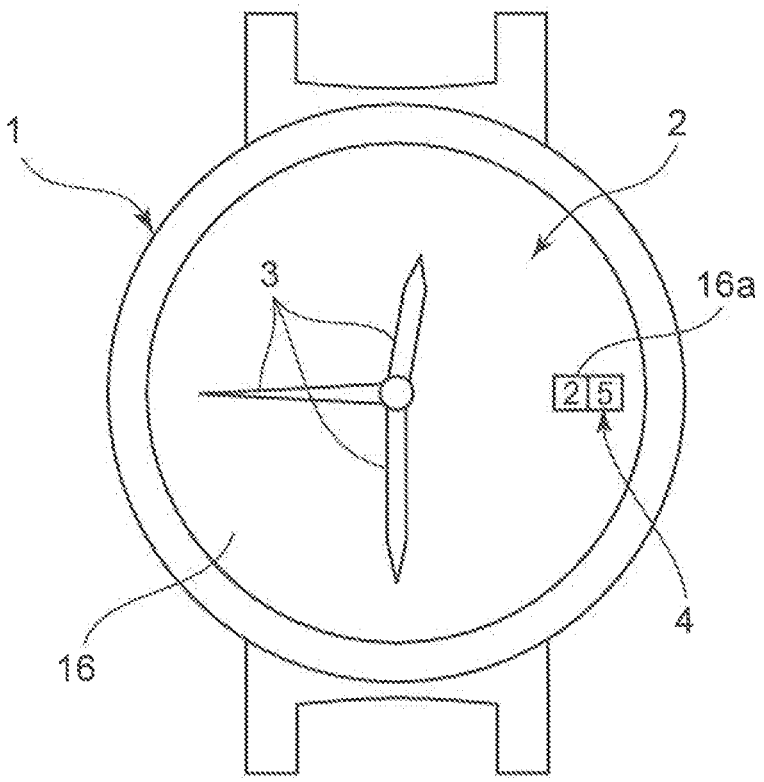
FIG. 1 is an enlarged front view of a first embodiment in which the present invention is applied to an electronic wristwatch.

The electronic wristwatch includes a wristwatch case 1 (device case), as shown in FIG. 1. A timepiece module 2 is stored within the wristwatch case 1. The timepiece module 2 includes a timepiece mechanism section (not shown) that indicates the time by moving hands 3 (e.g. a second hand, a minute hand, and an hour hand) and also includes a calendar mechanism section 4 that displays the date, as shown in FIG. 2.

The timepiece mechanism section transmits the rotation of a timepiece stepper motor to hand wheels (e.g. a second hand wheel, a minute hand wheel, and an hour hand wheel) by a gear train mechanism, thereby rotating the hand wheels. As a result, the hands 3 attached to a hand shaft of the hand wheels are moved and the time is indicated (not shown). In addition, the calendar mechanism section 4 includes a first display wheel 5 and a second display wheel 6, and thereby displays the date, as shown in FIG. 2.

Figure 2:
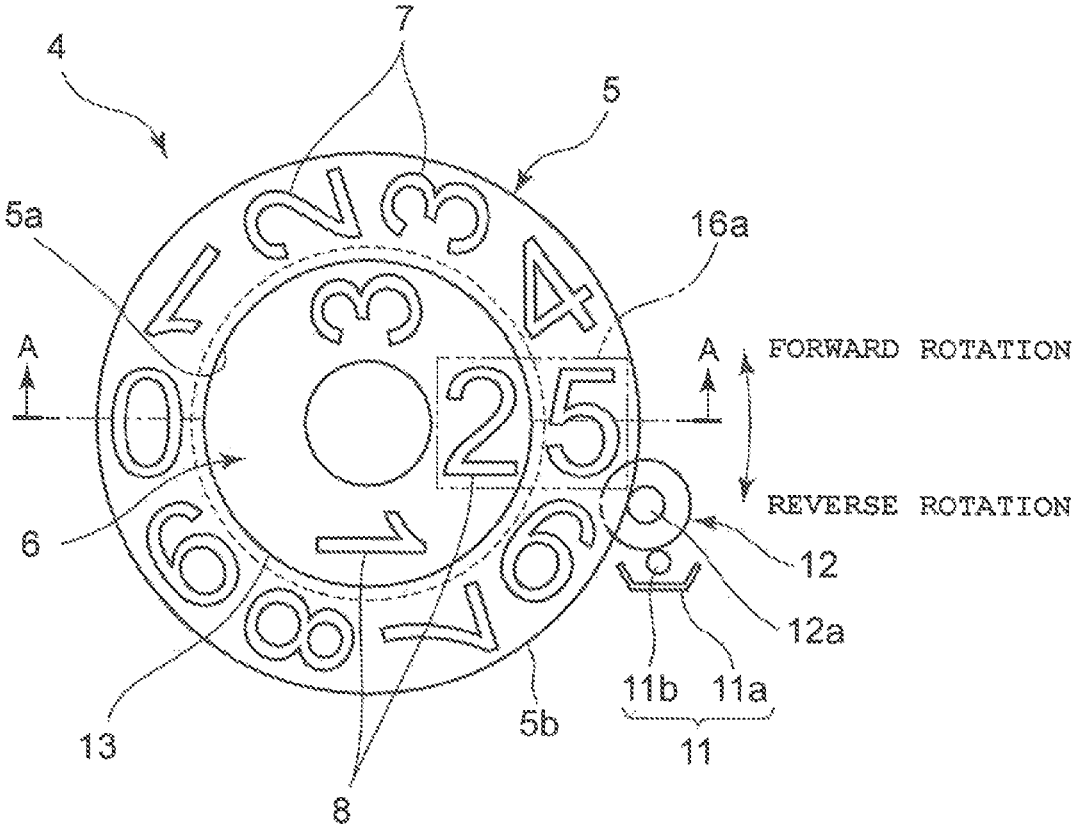
FIG. 2 is an enlarged front view of main sections of a calendar mechanism section in a timepiece module of the electronic wristwatch shown in FIG. 1.
Figure 3:
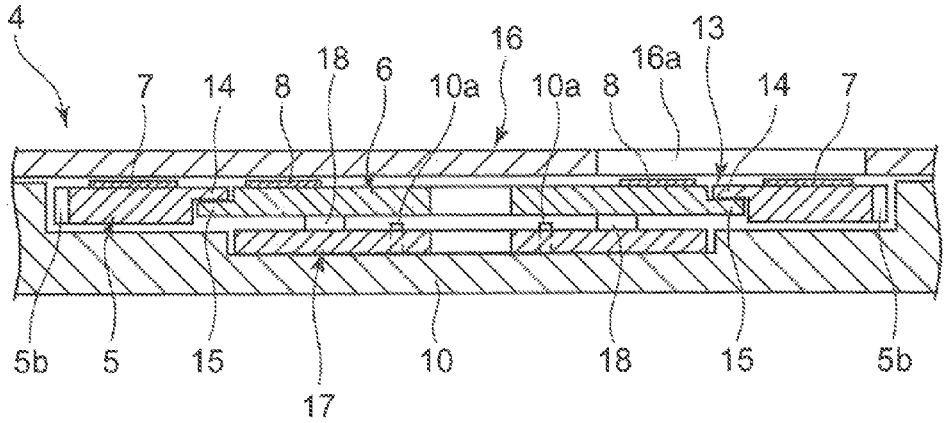
FIG. 3 is an enlarged cross-sectional view of the main sections of the calendar mechanism section shown in FIG. 2, taken along line A-A.
Figure 4A:
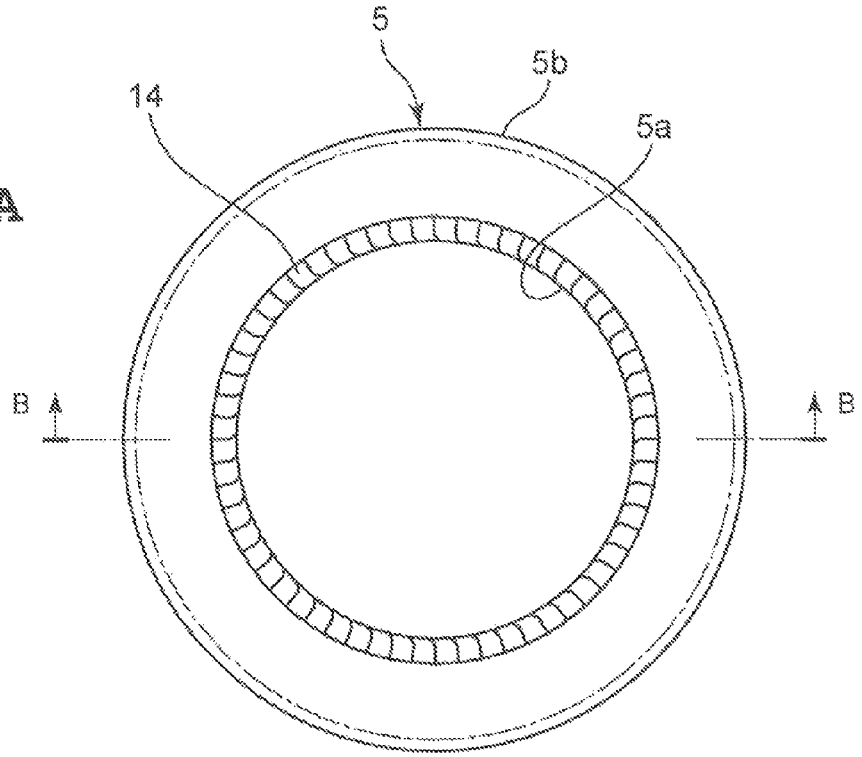
Figure 4B:
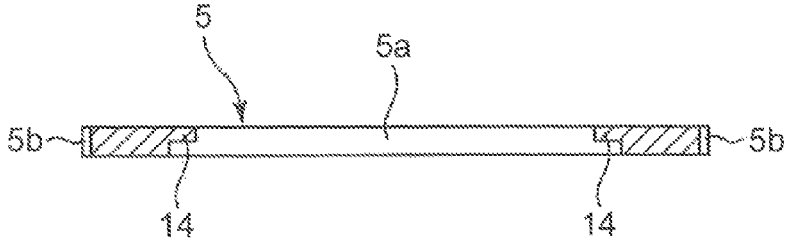
Figure 5A:
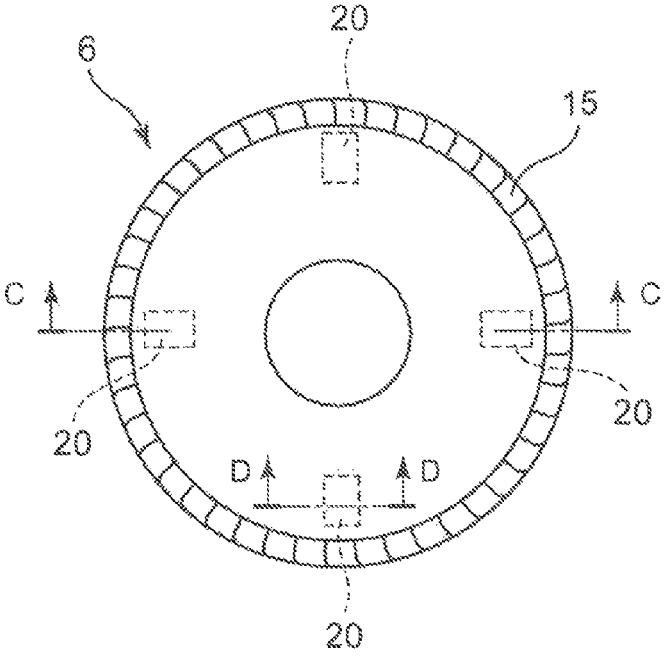
Figure 5B:
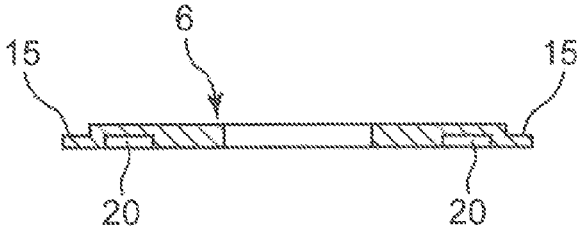
Figure 5C:
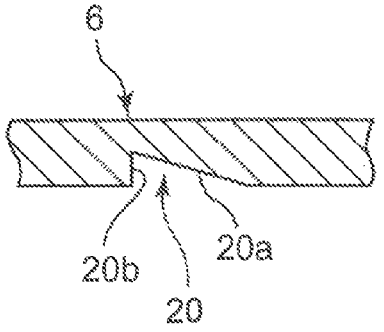

The first display wheel 5 of the calendar mechanism section 4 is formed into a ring shape where a circular hole 5*a* is provided in a center portion of first display wheel 5, as shown in FIG. 2, FIG. 4A, and FIG. 4B. The second display wheel 6 is formed into a circular shape and rotatably placed within the circular hole 5*a* of the first display wheel 5, as shown in FIG. 2, FIG. 3, FIG. 5A, FIG. 5B, and FIG. 5C. In this structure, first date display sections 7 (first display sections) are circularly provided on the top surface of the first display wheel 5 where the first date display sections 7 are numerals 0 to 9 standing for the first digit of the date, as shown in FIG. 2. Second date display sections 8 (second display sections) are circularly provided at a predetermined interval (e.g. at a 90 degree interval) on the top surface of the second display wheel 6 where the second date display sections 8 are numerals 1 to 3 standing for the second digits of the date.

The first display wheel 5 and the second display wheel 6 are rotatably placed on a housing 10 of the timepiece module 2, as shown in FIG. 3. The first display wheel 5 is rotated by a calendar stepper motor 11 which is a driving section dedicated to the calendar mechanism section 4, as shown in FIG. 2. In other words, the first display wheel 5 is rotated by that the rotation of the calendar stepper motor 11 is transmitted to the first display wheel 5 via a transmitting wheel 12.

In this structure, the calendar stepper motor 11 includes a stator 11*a* around which a coil is wound and a rotor 11*b* that is rotated by a magnetic field generated in the stator 11*a*, as shown in FIG. 2. The rotor 11*b* rotates in the forward direction and the reverse direction. The transmitting wheel 12 rotates by meshing with the pinion of the rotor 11*b* of the calendar stepper motor 11. The first display wheel 5 rotates by that the teeth section 5*b* provided on the outer peripheral portion of first display wheel 5 meshes with a pinion 12*a* of the transmitting wheel 12.

The first display wheel 5 and the second display wheel 6 include a rotating section 13 that rotates only the first display wheel 5 in the forward direction when the first display wheel 5 rotates in the forward direction, and rotates the second display wheel 6 in the reverse direction together with the first display wheel 5 when the first display wheel 5 rotates in the reverse direction, as shown in FIG. 3 to FIG. 5A, FIG. 5B, and FIG. 5C. The rotating section 13 has first clutch teeth 14 that are provided in the inner peripheral portion of the circular hole 5*a* of the first display wheel 5, and second clutch teeth 15 that are provided in the outer peripheral portion of the second display wheel 6 and meshed with the first clutch teeth 14, as shown in FIG. 7 and FIG. 8.

The first clutch teeth 14 and the second clutch teeth 15 are coupled with each other in the up/down direction, as shown in FIG. 3. In other words, the first clutch teeth 14 are provided in the upper inner peripheral portion of the circular hole 5*a* of the first display wheel 5 such that the first clutch teeth 14 project inwards. The second clutch teeth 15 are provided in the lower outer peripheral portion of the second display wheel 6 such that the second clutch teeth 15 project outwards. As a result, the first clutch teeth 14 are placed on the upper side of the second clutch teeth 15 such that the first clutch teeth 14 are coupled with the second clutch teeth 15.

Figure 7:
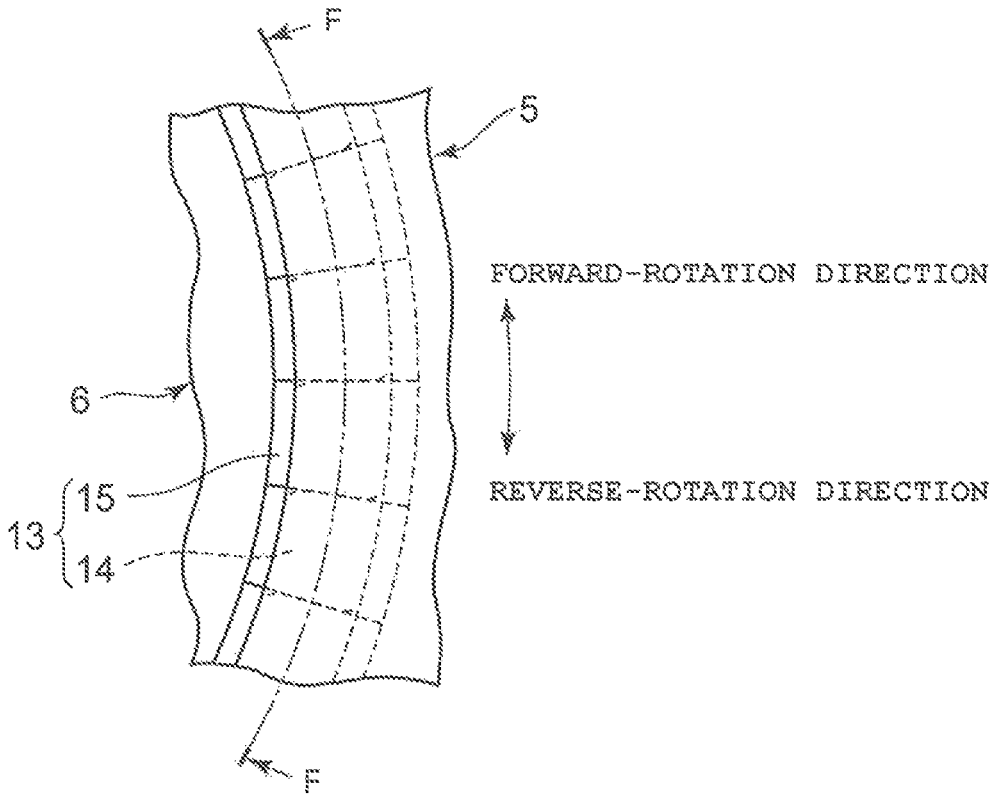
FIG. 7 is an enlarged front view of a portion where first clutch teeth of the first display wheel and second clutch teeth of the second display wheel are meshed in the calendar mechanism section shown in FIG. 2.
Figure 8:
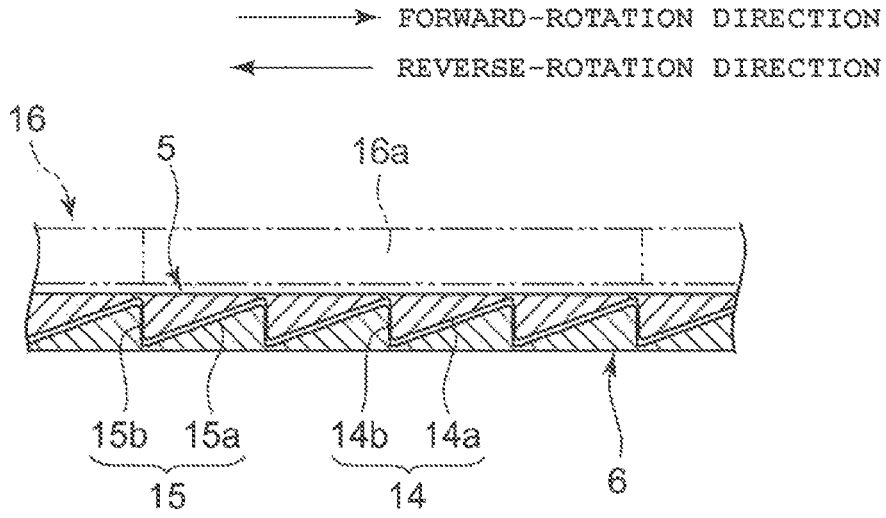
FIG. 8 is an enlarged cross-sectional view of main sections of the portion where the first clutch teeth of the first display wheel and the second clutch teeth of the second display wheel are meshed shown in FIG. 7, taken along line F-F.
Figure 9A:
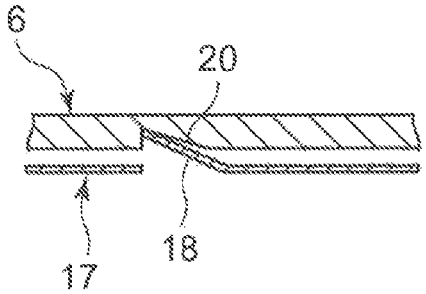
Figure 9B:
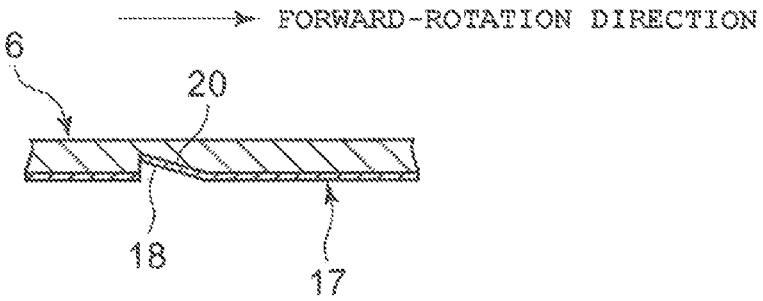
Figure 9C:
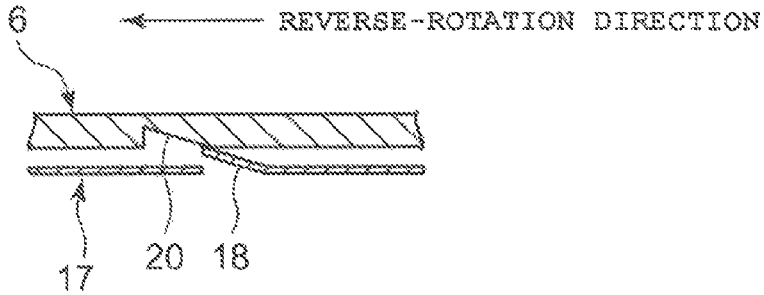

The first clutch teeth 14 have sliding surfaces 14*a* and pressing surfaces 14*b*, as shown in FIG. 7 and FIG. 8. The sliding surface 14*a* is gently inclined upward to the forward-rotation direction (counter-clockwise direction) of the first display wheel 5. The pressing surface 14*b* is provided at a substantially right angle or at an acute angle in the end portion of the sliding surface 14*a* positioned in the reverse-rotation direction (clockwise direction) of the first display wheel 5. In a similar manner, the second clutch teeth 15 have sliding surfaces 15*a* and pressing surfaces 15*b*. The sliding surface 15*a* is gently inclined upward to the forward-rotation direction of the first display wheel 5. The pressing surface 15*b* is provided at a substantially right angle or at an acute angle in the end portion of the sliding surface 15*a* positioned in the reverse-rotation direction of the first display wheel 5.

Figure 10A:
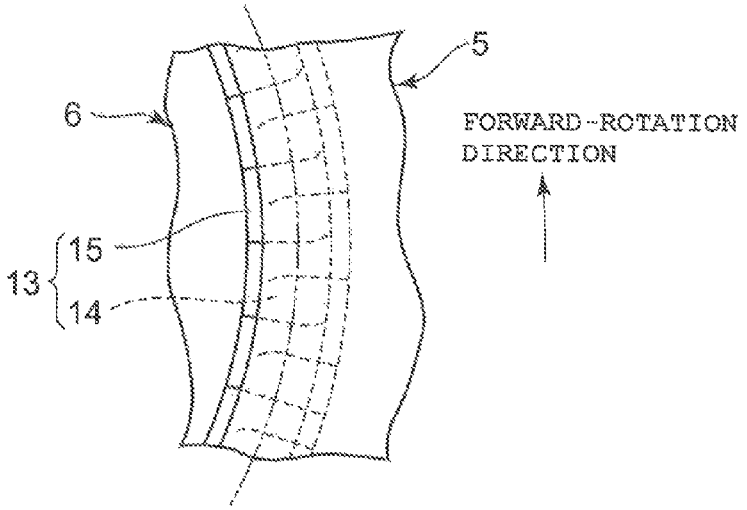
Figure 10B:
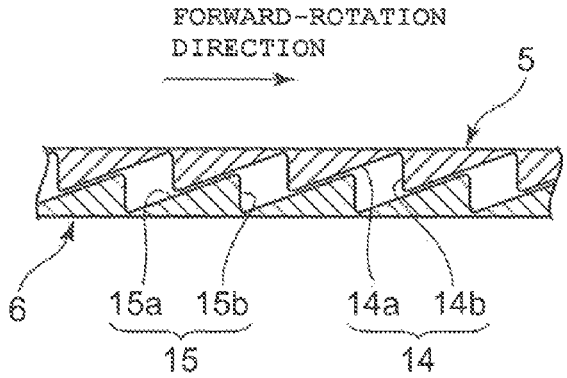

Accordingly, when the first display wheel 5 rotates in the forward direction (counter-clockwise direction), the sliding surfaces 14*a* of the first clutch teeth 14 and the sliding surfaces 15*a* of the second clutch teeth 15 slide against each other, whereby the first clutch teeth 14 and the second clutch teeth 15 become unmeshed, as shown in FIG. 10A and FIG. 10B. As a result, the rotating section 13 rotates only the first display wheel 5 in the forward direction.

Figure 11A:
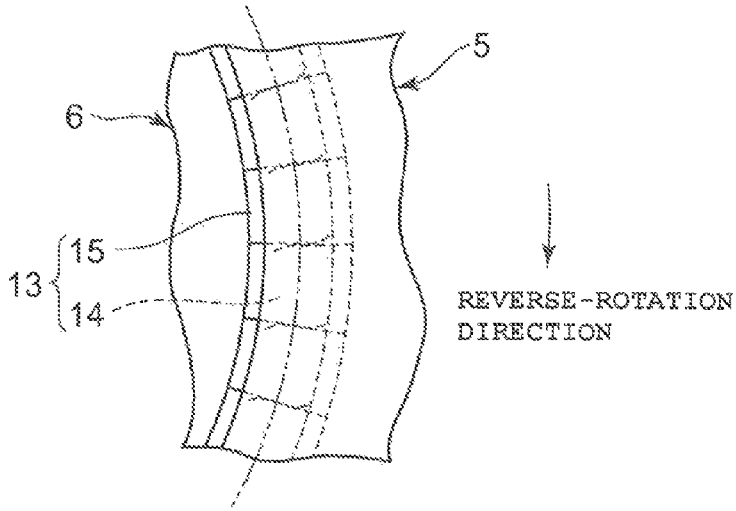
Figure 11B:
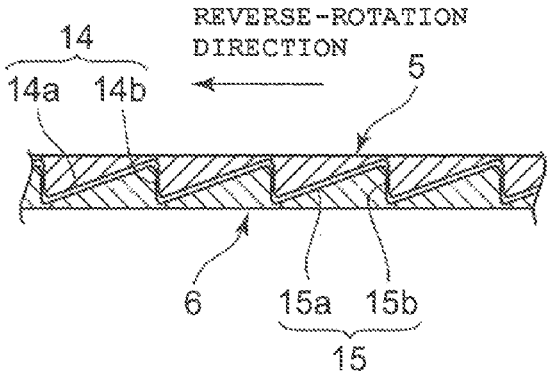

Whereas when the first display wheel 5 rotates in the reverse direction (clockwise direction), the pressing surfaces 14*b* of the first clutch teeth 14 and the pressing surfaces 15*b* of the second clutch teeth 15 come in contact with and presses against each other, as shown in FIG. 11A and FIG. 11B. As a result, the rotating section 13 rotates the second display wheel 6 in the reverse direction together with the first display wheel 5 in a state where the first clutch teeth 14 and the second clutch teeth 15 are meshed.

In this structure, a dial 16 is placed above the first display wheel 5 and the second display wheel 6, as shown in FIG. 3. The dial 16 is provided with a display window section 16*a* positioned on the 3 o'clock side, where one of the first date display sections 7 and one of the second date display sections 8 respectively correspond to the display window section 16*a*, as shown in FIG. 2. Accordingly, the first clutch teeth 14 and the second clutch teeth 15 are respectively formed into a predetermined length into which the length of the display window section 16*a* of the dial 16 in the rotation direction is equally divided, such as about ¼ of the length of the display window section 16*a*.

In other words, the first clutch teeth 14 and the second clutch teeth 15 are respectively formed such that the length between each tooth (pitch) in the rotation direction of the first display wheel 5 is a predetermined length into which the length of the display window section 16*a* in the rotation direction is equally divided, such as about ¼ of the length of the display window section 16*a*, as shown in FIG. 8. As a result, a predetermined number of the first clutch teeth 14 and the second clutch teeth 15 (e.g. four teeth) are respectively placed corresponding to the display window section 16*a*.

Figure 6A:
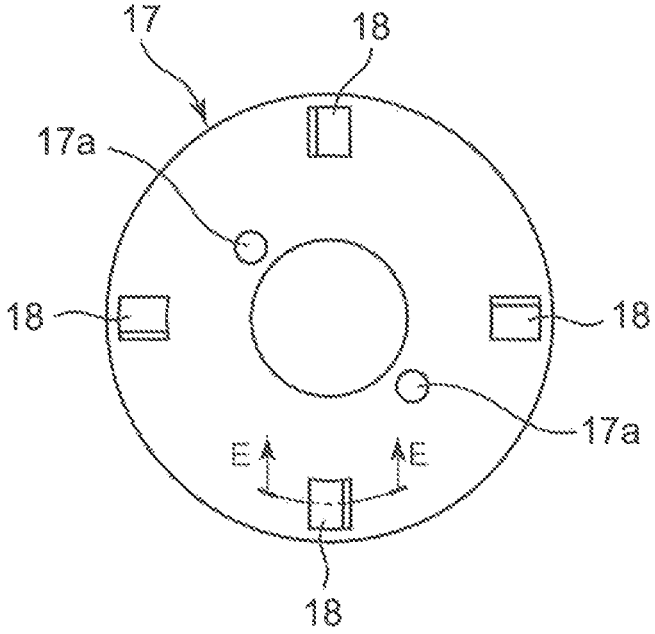
Figure 6B:
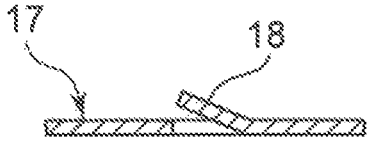

On the other hand, a brake member 17 is placed between the second display wheel 6 and the housing 10 of the timepiece module 2, as shown in FIG. 3. The brake member 17 is formed into a disk shape that is substantially the same size as the second display wheel 6, as shown in FIG. 6A and FIG. 6B. The brake member 17 is fixed onto the housing 10 because projecting pins 10*a* on the housing 10 are inserted into the attachment holes 17*a* provided in predetermined positions of the brake member 17. The brake member 17 is provided with a plurality of flat spring sections 18 that resiliently lift the second display wheel 6 upward and resiliently press the second clutch teeth 15 against the first clutch teeth 14.

The plurality of flat spring sections 18 are provided in four portions of the brake member 17 positioned on the 12 o'clock, 3 o'clock, 6 o'clock, and 9 o'clock sides in an inclined state where each of the plurality of the flat spring sections 18 is bent obliquely upward in the reverse-rotation direction (left side in FIG. 6B) of the first display wheel 5, as shown in FIG. 6A and FIG. 6B. Each of the plurality of flat spring sections 18 engageably or disengageably locks with each of a plurality of sloped recessing sections 20 provided in four portions on the undersurface of the second display wheel 6 positioned on the 12 o'clock, 3 o'clock, 6 o'clock, and 9 o'clock sides, as shown in FIG. 5A, FIG. 5B, FIG. 5C, FIG. 9A, FIG. 9B, and FIG. 9C.

Each of the plurality of sloped recessing sections 20 has a sloped surface 20*a* and a contact surface 20*b*, as shown in FIG. 5A, FIG. 5B, FIG. 5C, FIG. 9A, FIG. 9B, and FIG. 9C. The sloped surface 20*a* is bent obliquely upward in the reverse-rotation direction (left side in FIG. 5C) of the first display wheel 5. The contact surface 20*b* is provided at a substantially right angle in the end portion of the sloped surface 20*a* positioned in the reverse-rotation direction of the first display wheel 5. The sloped recessing section 20 is configured as follows when the second display wheel 6 rotates in response to the forward rotation of the first display wheel 5, the tip portions of the flat spring sections 18 move along the sloped surface 20*a*, thereby coming in contact with the contact surface 20*b*; when the second display wheel 6 rotates in response to the reverse rotation of the first display wheel 5, the tip portions of the flat spring sections 18 move along the sloped surfaces 20*a*, thereby disengaging.

Figure 10C:
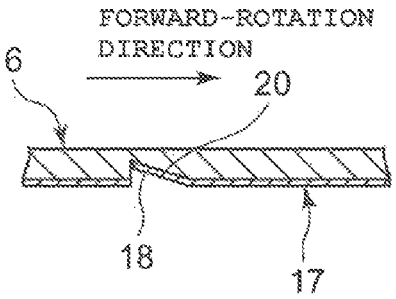

Accordingly, the brake member 17 is configured as follows: when the first display wheel 5 rotates in the forward direction, the tip portions of the flat spring sections 18 relatively move along the sloped surfaces 20*a* of the sloped recessing sections 20 of the second display wheel 6 in response to the rotation of the second display wheel 6, thereby coming in contact with and being locked by the contact surfaces 20*b* of the sloped recessing sections 20. As a result, the rotation of the second display wheel 6 is prevented, as shown in FIG. 10A, FIG. 10B, and FIG. 10C.

In addition, the brake member 17 is configured as follows in the state where the rotation of the second display wheel 6 is prevented by the flat spring sections 18, the sliding surfaces 14*a* of the first clutch teeth 14 and the sliding surfaces 15*a* of the second clutch teeth 15 slide against each other in response to the forward rotation of the first display wheel 5. When the first clutch teeth 14 and the second clutch teeth 15 become unmeshed, the flat spring sections 18 are pressed downward by the second display wheel 6. As a result, the flat spring sections 18 are resiliently deformed in the up/down direction, and the first clutch teeth 14 and the second clutch teeth 15 become sequentially unmeshed, as shown in FIG. 10A, FIG. 10B, and FIG. 10C.

Figure 11C:
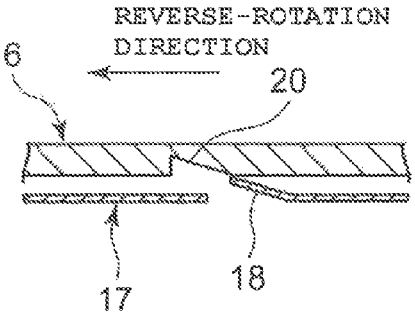

Furthermore, the brake member 17 is configured as follows when the first display wheel 5 rotates in the reverse direction, the tip portions of the flat spring sections 18 relatively move along the sloped surfaces 20*a* of the sloped recessing sections 20 of the second display wheel 6 in response to the rotation of the second display wheel 6, thereby disengaging from within the sloped recessing sections 20. As a result, the rotation restriction on the second display wheel 6 are released and the second display wheel 6 rotates in the reverse direction together with the first display wheel 5, as shown in FIG. 11A, FIG. 11B, and FIG. 11C.

Figure 12:
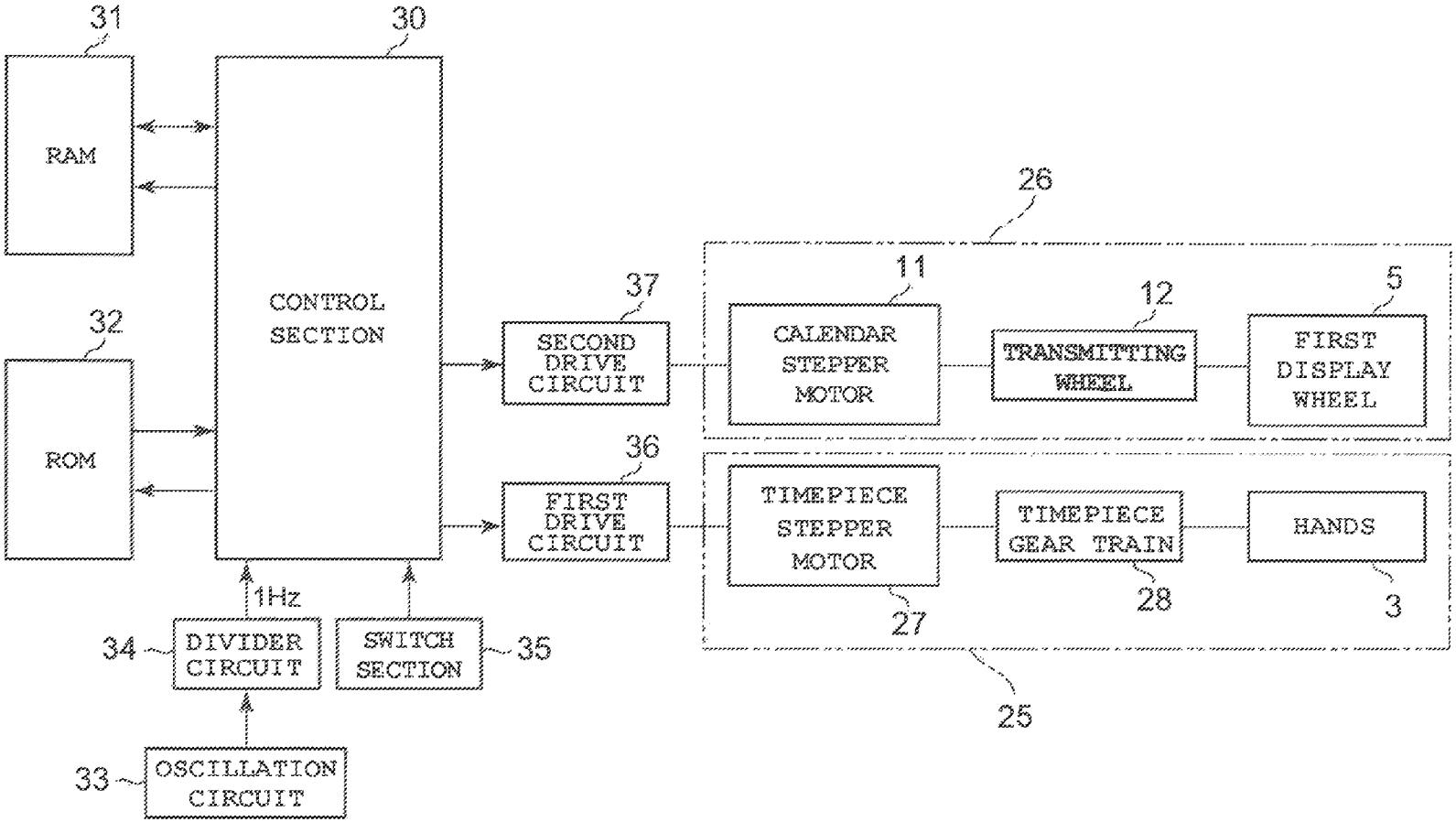
FIG. 12 is a block diagram of a circuit configuration of the timepiece module in the electronic wristwatch shown in FIG. 1.

Next, a circuit configuration of the pointer type electronic wristwatch will be described with reference to the block diagram in FIG. 12.

The pointer type electronic wristwatch includes a timepiece driving system 25 that drives the hands 3 (e.g. the second hand, the minute hand, and the hour hand), and a calendar driving system 26 that changes the date. The timepiece driving system 25 includes a timepiece stepper motor 27 that drives the hands 3 via a timepiece gear train 28. The calendar driving system 26 includes the calendar stepper motor 11 that drives the first display wheel 5 via the transmitting wheel 12.

In addition, the pointer type electronic wristwatch includes: a control section 30 that performs overall integrated control of the timepiece with a Central Processing Unit (CPU) and the like built therein; a Random Access Memory (RAM) 31 that provides the CPU of the control section 30 with a work memory space; and a Read-Only Memory (ROM) 32 that stores therein various programs executed by the CPU of the control section 30, initial setting data, and the like.

Furthermore, the pointer type electronic wristwatch includes: an oscillation circuit 33 that generates and outputs an oscillation signal of a fixed frequency; a divider circuit 34 that divides the oscillation signal inputted from the oscillation circuit 33 and generates a reference frequency signal for hand movement which is used for time display, for example; a switch section 35 that converts an operation performed by a user into an electrical signal and outputs the electrical signal to the control section 30; and a first drive circuit 36 and a second drive circuit 37 that respectively drive the timepiece stepper motor 27 and the calendar stepper motor 11 by outputting a drive pulse in response to the control signals from the control section 30.

The control section 30 performs clocking processing for keeping the time and the following processing: setting a pulse width and a voltage value of a drive pulse, based on time data acquired by the clocking processing and an input signal from the switch section 35 etc.; and then making the first and second drive circuits 36 and 37 output the drive pulse to the timepiece stepper motor 27 and the calendar stepper motor 11, respectively.

The first drive circuit 36 outputs a drive pulse to drive the timepiece stepper motor 27 that moves the hands 3. The second drive circuit 37 outputs a drive pulse to drive the calendar stepper motor 11 that rotates the first display wheel 5. A signal length and a voltage value of each of these drive pulses is set based on instructions from the control section 30. In response to each of these drive pulses, the amount of current sent to the timepiece stepper motor 27 and the calendar stepper motor 11 changes, respectively.

Figure 13:
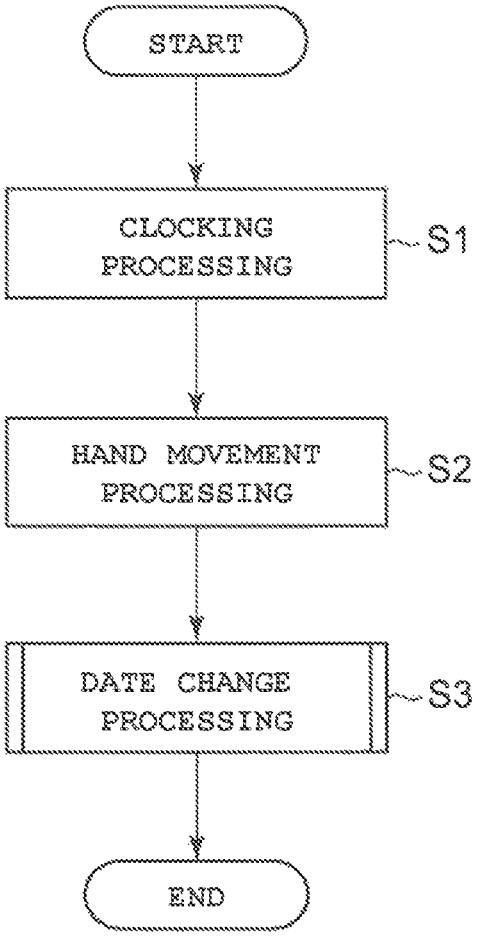
FIG. 13 is an operation flow of control processing for driving a timepiece and driving a calendar performed by a CPU of a control section in the circuit configuration shown in FIG. 12.

Next, operation procedures for driving the timepiece drive system 25 and the calendar drive system 26 in the pointer type electronic wristwatch will be described with reference to an operation flow shown in FIG. 13, where FIG. 13 is a diagram of the procedures in control processing performed by the CPU of the control section 30.

The control processing is interrupt processing that is started by the CPU of the control section 30 in response to a 1 Hz signal inputted from the divider circuit 34 to the control section 30. When the interrupt processing is invoked and started at the drive timing of the hands 3, the CPU performs the clocking processing of Step S1.

In other words, the CPU updates the current time data by adding one second to the current time data stored in the RAM 31. When the processing of CPU proceeds to Step S2, the CPU instructs the first drive circuit 36 so that the first drive circuit 36 supplies a drive pulse to the time piece stepper motor 27, whereby the timepiece stepper motor 27 is rotated by one step. Then, the rotation of the timepiece stepper motor 27 is transmitted to the hands 3, and the hands 3 are moved. As a result, the time is indicated. When the processing of the CPU proceeds to Step S3, the CPU performs date change processing to update the date and then ends the operation flow.

Figure 14:
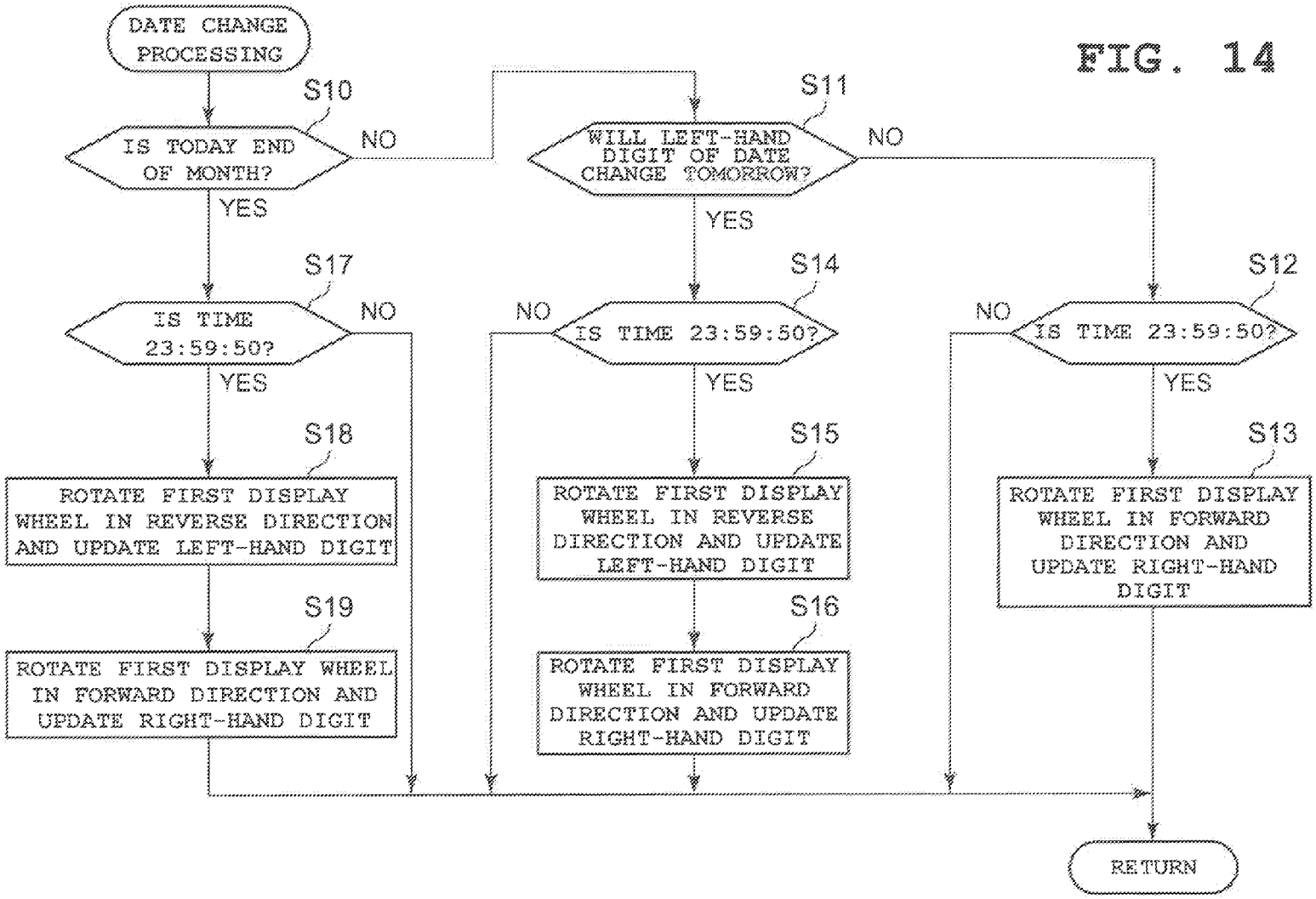
FIG. 14 is a diagram of an operation flow of date change processing of the calendar mechanism section performed in the control processing shown in FIG. 13.

Next, operation procedures of the date change processing for driving the calendar driving system 26 and changing the date will be described with reference to the operation flow shown in FIG. 14.

When the date change processing is started, the CPU judges at Step S10 whether or not today (the current day) is the end of the month. At this time, when judged that today is not the end of the month, the processing of the CPU proceeds to Step S11 and then the CPU judges whether or not the second digit of the date will change on the following day (tomorrow). When judged that the second digit will not change, the processing of the CPU proceeds to Step S12 and then the CPU judges whether or not the time is 23:59:50.

At this time, when judged that the time is not 3:59:50, the CPU returns to the control processing in the main flow and waits until the time is 23:59:50. When judged at Step S12 that the time is 23:59:50, the processing of the CPU proceeds to Step S13 and then the CPU instructs the second drive circuit 37 to output a forward-rotation drive pulse to the calendar stepper motor 11. As a result, the calendar stepper motor 11 is rotated in the forward direction and then the first display wheel 5 is rotated in the forward direction. At this time, the first display wheel 5 is rotated in the forward direction by an amount equivalent to one day of the date, such as by four teeth of the first clutch teeth 14.

As a result, the CPU updates the one of the first date display sections 7, which is provided on the first display wheel 5 and stands for the first digit, corresponding to the display window section 16*a* of the dial 16, and returns to the control processing in the main flow. At this time, the second display wheel 6 does not rotate even when the first display wheel 5 rotates. In other words, when the first display wheel 5 rotates in the forward direction, the tip portions of the flat spring sections 18 of the brake member 17 come in contact with the contact surfaces 20*b* of the sloped recessing sections 20 of the second display wheel 6, and the rotation of the second display wheel 6 is prevented, as shown in FIG. 10C.

Therefore, the sliding surfaces 14*a* of the first clutch teeth 14 of the first display wheel 5 and the sliding surfaces 15*a* of the second clutch teeth 15 of the second display wheel 6 slide against each other, and the first clutch teeth 14 and the second clutch teeth 15 become unmeshed, as shown in FIG. 10B. At this time, the first clutch teeth 14 and the second clutch teeth 15 become sequentially unmeshed while the flat spring sections 18 of the brake member 17 are pressed downward and resiliently deformed by the second display wheel 6.

As a result, only the first display wheel 5 rotates in the forward direction, and the one of the first date display sections 7, which stands for the first digit of the date, corresponding to the display window section 16*a* of the dial 16 is changed by one day, whereby the date is updated. At this time, the second display wheel 6 idles, and the one of the second date display section 8, which stands for the second digit of the date, maintains its current state.

When judged at Step S11 that the second digit of the date will change on the following day, the processing of the CPU proceeds to Step S14 and then the CPU judges whether or not the time is 23:59:50. At this time, when judged that the time is not 23:59:50, the CPU returns to the control processing in the main flow and waits until the time is 23:59:50 When judged at Step S14 that the time is 23:59:50, the processing of the CPU proceeds to Step S15 and then the CPU instructs the second drive circuit 37 to output a reverse-rotation drive pulse to the calendar stepper motor 11. As a result, the calendar stepper motor 11 is rotated in the reverse direction.

And then, the first display wheel 5 is rotated in the reverse direction, and whereby the second display wheel 6 is rotated in the reverse direction together with the first display wheel 5 by the reverse rotation of the first display wheel 5. As a result, the one of the second date display sections 8 standing for the second digit is updated. At this time, the first display wheel 5 rotates in the reverse direction by an amount equivalent to an interval among the second date display sections 8 provided on the second display wheel 6, such as by 14 teeth of the first clutch teeth 14. As a result, the one of the second date display sections 8 standing for the second digit is updated. In other words, when the first display wheel 5 rotates in the reverse direction, the tip portions of the flat spring sections 18 of the brake member 17 relatively move along the sloped surfaces 20*a* of the sloped recessing sections 20 of the second display wheel 6 and are disengaged from the sloped recessing sections 20, whereby the rotation restriction on the second display wheel 6 is released, as shown in FIG. 11C.

As a result, the pressing surfaces 14*b* of the first clutch teeth 14 of the first display wheel 5 and the pressing surfaces 15*b* of the second clutch teeth 15 of the second display wheel 6 come in contact with each other, and the first clutch teeth 14 and the second clutch teeth 15 become meshed, as shown in FIG. 11B. In this state, the second display wheel 6 rotates in the reverse direction together with the first display wheel 5. At this time, the first display wheel 5 rotates in the reverse direction by a predetermined angle, and whereby the one of the first date display sections 7, which stands for the first digit, corresponding to the display window section 16*a* of the dial 16 is reversed such as by three days earlier. In addition, the second display wheel 6 rotates together with the first display wheel 5, and whereby the one of the second date display sections 8, which stands for the second digit, corresponding to the display window section 16*a* of the dial 16 is forwarded by an interval among the second date display sections 8.

When the one of the second date display sections 8, which is provided on the second display wheel 6 and stands for the second digit, is changed and updated as described above, the processing of the CPU proceeds to Step S16 and then the CPU instructs the second drive circuit 37 to output a forward-rotation drive pulse to the calendar stepper motor 11. As a result, the calendar stepper motor 11 is rotated in the forward direction. And then, the first display wheel 5 is rotated in the forward direction by an amount equivalent to the number of days required to update the one of the first date display sections 7, such as by 18 teeth of the first clutch teeth 14.

In other words, at Step S15, the first display wheel 5 has been rotated in the reverse direction and reversed by three days earlier, such as by an amount equivalent to 14 teeth of the first clutch teeth 14. Accordingly, the first display wheel 5 is rotated in the forward direction by the same amount as the first display wheel 5 was rotated in the reverse rotation, and is then further rotated in the forward direction by an amount equivalent to one day, such as by four teeth of the first clutch teeth 14. At this time as well, the second display wheel 6 idles, and the one of the second date display sections 8 standing for the second digit of the date maintains its current state. As a result, the one of the first date display sections 7 and the one of the second date display sections 8 respectively corresponding to the display window section 16*a* of the dial 16 are changed and updated, where the one of the first date display sections 7 is provided on the first display wheel 5 and stand for the first digit of the date, and the one of the second date display sections 8 is provided on the second display wheel 6 and stand for the second digit of the date. And then, the CPU returns to the control processing in the main flow.

When judged at Step S10 that today is the end of the month, the processing of the CPU proceeds to Step S17 and then the CPU judges whether or not the time is 23:59:50. At this time, when judged that the time is not 23:59:50, the CPU returns to the control processing in the main flow and waits until the time is 23:59:50. When judged at Step S17 that the time is 23:59:50, the processing of the CPU proceeds to Step S18 and then the CPU instructs the second drive circuit 37 to output a reverse-rotation drive pulse to the calendar stepper motor 11. As a result, the calendar stepper motor 11 is rotated in the reverse direction.

And then, the first display wheel 5 is rotated in the reverse direction, and the second display wheel 6 is rotated by the reverse rotation of the first display wheel 5. As a result, the one of the second date display sections 8, which is provided on the second display wheel 6 and stands for the second digit, corresponding to the display window section 16*a* of the dial 16 is updated. At this time, the first display wheel 5 is rotated in the reverse direction and whereby the second display wheel 6 is rotated until a section representing "0" among the second date display sections 8, i.e. a blank section intermediately located between "3" (30th) and "1" (10th), corresponds to the display window section 16*a* of the dial 16.

Figures 15A, 15B, 15C:
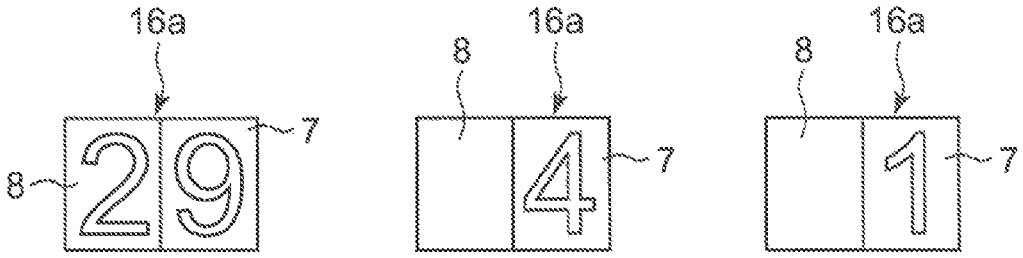

For example, when today is February 29th (leap year) as shown in FIG. 15A, the second display wheel 6 is rotated by the reverse rotation of the first display wheel 5 and whereby the one of the second date display sections 8, which is provided on the second display wheel 6 and stands for the second digit, corresponding to the display window section 16*a* of the dial 16 (i.e. "2" (20th)) changes to the blank section, as shown in FIG. 15B. At this time, the first display wheel 5 rotates in the reverse direction by 180 degrees, and "4" (4th) of the first date display sections 7, which is provided on the first display wheel 5 and stands for the first digit corresponds to the display window section 16*a* of the dial 16.

Then, when the one of the second date display sections 8, which is provided on the second display wheel 6 and stands for the second digit is changed, the processing of the CPU proceeds to Step S19 and then the CPU instructs the second drive circuit 37 to output a forward-rotation drive pulse to the calendar stepper motor 11. As a result, the calendar stepper motor 11 rotated in the forward direction. At this time, the first display wheel 5 has been rotated in the reverse direction by 180 degrees at Step S18. Accordingly, the first display wheel 5 is rotated in the forward direction by the same amount as the first display wheel 5 was rotated in the reverse rotation, and is then further rotated in the forward direction by an amount equivalent to the number of days required to update the one of the first date display sections 7, such as by eight teeth of the first clutch teeth 14.

In the example shown in FIG. 15B, "4" (4th) of the first date display sections 7, which is provided on the first display wheel 5 and stands for the first digit, has corresponded to the display window section 16*a* of the dial 16. Accordingly, the one of the first date display sections 7 standing for the first digit (i.e. "4") changes to "9" when the first display wheel 5 is rotated in the forward direction by 180 degrees. Then, the first display wheel 5 is further rotated in the forward direction by an amount equivalent to two days, such as by eight teeth of the first clutch teeth 14. At this time, the one of the first date display sections 7, which stands for the first digit, corresponding to the display window section. 16*a* of the dial 16 (i.e. "9") changes via "0" to by the forward rotation of the first display wheel 5, as shown in FIG. 15C.

As a result, "1" of the first date display sections 7 for the first digit corresponds to the display window section 16*a* of the dial 16, and whereby the date is changed. At this time as well, the second display wheel 6 idles, and the one of the second date display sections 8 standing for the second digit of the date remains the blank section. Therefore, the date corresponding to the display window section 16*a* of the dial 16 becomes "1". As described above, the date corresponding to the display window section 16*a* of the dial 16 is updated, and then the CPU returns to the control processing in the main flow.

As described above, the calendar mechanism section 4 that is the display apparatus of an electronic wristwatch includes: <CLAIM 1> the first display wheel 5 that has the first date display section 7; the second display wheel 6 that has the second date display section 8; the calendar stepper motor 11, a driving section, that rotates in the forward direction and the reverse direction, and rotates the first display wheel 5 in the forward direction and the reverse direction; and the rotating section 13 that rotates only the first display wheel 5 in the forward direction when the first display wheel 5 is rotated in the forward direction, and rotates the second display wheel 6 in the reverse direction together with the first display wheel 5 when the first display wheel 5 is rotated in the reverse direction. Therefore, the structure can be simplified, and the respective numerals of the first date display sections 7 and the second date display sections 8 can be easily and optimally changed and updated merely by the forward rotation and the reverse rotation of just one calendar stepper motor 11.

In other words, in the calendar mechanism section 4 of an electronic wristwatch, the calendar stepper motor 11, which is a driving section, is rotated in the forward direction and whereby the first display wheel 5 is rotated in the forward direction. As a result, a numeral of the first date display sections 7 can be changed. In addition, the rotating section 13 enables only the first display wheel 5 to rotate in the forward direction. As a result, a numeral of the second date display sections 8 can maintain its current state. Whereas, the calendar stepper motor 11 is rotated in the reverse direction and whereby the first display wheel 5 is rotated in the reverse direction. As a result, the rotating section 13 enables the second display wheel 6 to rotate in the reverse direction together with the first display wheel 5, and a numeral of the second date display sections 8 can be changed and updated.

As described above, the calendar mechanism section 4 is a simple structure that merely has the rotating section 13. Furthermore, by the forward rotation and the reverse rotation of just one calendar stepper motor 11, the respective numeral of the first date display section 7 and the second date display section 8 can be easily and appropriately changed. In addition, date display can be about three times as large as existing date displays because the first date display section 7 is provided on the first display wheel 5 and the second date display section 8 is provided on the second display wheel 6. As a result, visibility of date display can be improved.

In this structure, the rotating section 13 includes the first clutch teeth 14 that are provided on the first display wheel 5, and the second clutch teeth 15 that are provided on the second display wheel 6 and meshed with the first clutch teeth 14. The first clutch teeth 14 and the second clutch teeth 15 are coupled with each other in the up/down direction, in this state, when the first display wheel 5 is rotated in the forward direction, the first clutch teeth 14 and the second clutch teeth 15 become unmeshed, whereby only the first display wheel 5 rotates in the forward direction. Whereas, when the first display wheel 5 is rotated in the reverse direction, the first clutch teeth 14 and the second clutch teeth 15 are meshed and rotated, whereby the second display wheel 6 rotates in the reverse direction together with the first display wheel 5. As a result, a numeral of the first date display sections 7 can be changed by the forward rotation of the first display wheel 5. Whereas, a numeral of the second date display sections 8 provided on the second display wheel 6 can maintain its current state because only the first display wheel 5 can be rotated in the forward direction. Furthermore, the second date display sections 8 provided on the second display wheel 6 can be changed by the reverse rotation of the first display wheel 5.

In other word, when the first display wheel 5 rotates in the forward direction, the first clutch teeth 14 and the second clutch teeth 15 becomes unmeshed, whereby only the first display wheel 5 can rotate in the forward direction. As a result, a numeral of only the first date display sections 7 provided on the first display wheel 5 can be changed, and a numeral of the second date display sections 8 provided on the second display wheel 6 can maintain its current state. Whereas, when the first display wheel 5 rotates in the reverse direction, the first clutch teeth 14 can be meshed and rotated with the second clutch teeth 15. As a result the second display wheel 6 can be rotated in the reverse direction together with the first display wheel 5. Therefore, a numeral of the second date display sections 8 of the second display wheel 6 can be unfailingly changed.

In addition, in the calendar mechanism section 4, the first clutch teeth 14 and the second clutch teeth 15 of the rotating section 13 respectively have: the sliding surfaces 14*a* and the sliding surfaces 15*a* that are gently inclined towards the forward-rotation direction of the first display wheel 5; and the pressing surfaces 14*b* and the pressing surfaces 15*b* that are provided in the end portions of the sliding surfaces 14*a* and the sliding surfaces 15*a* positioned in the reverse-rotation direction of the first display wheel 5. Therefore, when the first display wheel 5 rotates in the forward direction, the sliding surfaces 14*a* of the first clutch teeth 14 and the sliding surfaces 15*a* of the second clutch teeth 15 can be favorably slid and smoothly unmeshed.

In addition, in the calendar mechanism section 4, when the first display wheel 5 rotates in the reverse direction, the pressing surfaces 14*b* of the first clutch teeth 14 and the pressing surfaces 15*b* of the second clutch teeth 15 can come in contact with each other. As a result, the second display wheel 6 can be unfailingly rotated by the rotation of the first display wheel 5. Therefore, a numeral of the first date display sections 7 of the first display wheel 5 and a numeral of the second date display sections 8 of the second display wheel 6 can be unfailingly and appropriately changed by that the first display wheel 5 is rotated in the forward direction and the reverse direction.

In this structure, the first display wheel 5 is formed into a ring shape where the circular hole 5*a* is provided in a center portion of first display wheel 5. The first clutch teeth 14 are circularly provided in the inner peripheral portion of the circular hole 5*a*. The second display wheel 6 is formed into a circular shape and rotatably placed within the circular hole 5*a* of the first display wheel 5. The second clutch teeth 15 are circularly provided in the outer peripheral portion of the second display wheel 6 such that the second clutch teeth 15 are coupled and meshed with the first clutch teeth 14. As a result, the first display wheel 5 and the second display wheel 6 can be configured compactly, whereby the whole wristwatch can be more compact and smaller.

In addition, in the calendar mechanism section 4, the brake member 17 is provided for applying a brake on the rotation of the second display wheel 6, such that the brake member 17 restricts the rotation of the second display wheel 6 when the first display wheel 5 rotates in the forward direction, and that the brake member 17 releases the rotation restriction on the second display wheel 6 when the first display wheel 5 rotates in the reverse direction. Therefore, the second display wheel 6 can be idled and rotated by the forward rotation and the reverse rotation of the first display wheel 5, respectively. As a result, operation reliability of the second display wheel 6 can be improved.

In other words, in the calendar mechanism section 4, when the first display wheel 5 rotates in the forward direction, the brake member 17 can restrict the rotation of the second display wheel 6, and prevent the second display wheel 6 from rotating. As a result, only the first display wheel 5 can be rotated, and the second display wheel 6 can be favorably idled. Whereas, when the first display wheel 5 rotates in the reverse direction, the brake member 17 can release the rotation restriction on the second display wheel 6. As a result, the first clutch teeth 14 of the first display wheel 5 and the second clutch teeth 15 of the second display wheel 6 can be unfailingly meshed, and whereby the second display wheel 6 can be unfailingly rotated in the reverse direction together with the first display wheel 5.

In this structure, the brake member 17 has the flat spring sections 18 that are placed below the second display wheel 6 and resiliently press the second clutch teeth 15 against the first clutch teeth 14. The flat spring sections 18 is inclined in a state where each of the flat spring sections 18 is bent obliquely upward in the forward-rotation direction of the first display wheel 5. The sloped tip portions engageably or disengageably locks with the sloped recessing sections 20 provided in the second display wheel 6. Therefore, the rotation of the second display wheel 6 can be unfailingly restricted when the first display wheel 5 is rotated in the forward direction, whereas the rotation restriction on the second display wheel 6 can be unfailingly released when the first display wheel 5 is rotated in the reverse direction.

In other words in the brake member 17, when the first display wheel 5 rotates in the forward direction, the tip portions of the flat spring sections 18 can be locked with the sloped recessing sections 20 of the second display wheel 6, and the rotation of the second display wheel 6 can be unfailingly restricted, whereas, when the first display wheel 5 rotates in the reverse direction, the flat spring sections 18 can be resiliently deforms in the up/down direction and disengages from the sloped recessing sections 20. As a result, the rotation restriction on the second display wheel 6 can be unfailingly released, and the second display wheel 6 can be smoothly rotated in the reverse direction together with the first display wheel 5.

(Second Embodiment)

Next, a second embodiment in which the present invention has been applied to an electronic wristwatch will be described with reference to FIG. 16 to FIG. 20A, FIG. 20B, and FIG. 20C. Note that sections that are the same as those in the first embodiment shown in FIG. 1 to FIG. 15A, FIG. 15B, and FIG. 15C are given the same reference numerals.

In a calendar mechanism section 40 of the electronic wristwatch, a first display wheel 41 and a second display wheel. 42 in the second embodiment have different configurations from those in the first embodiment. Other sections have substantially similar configurations to those in the first embodiment.

Figure 16:
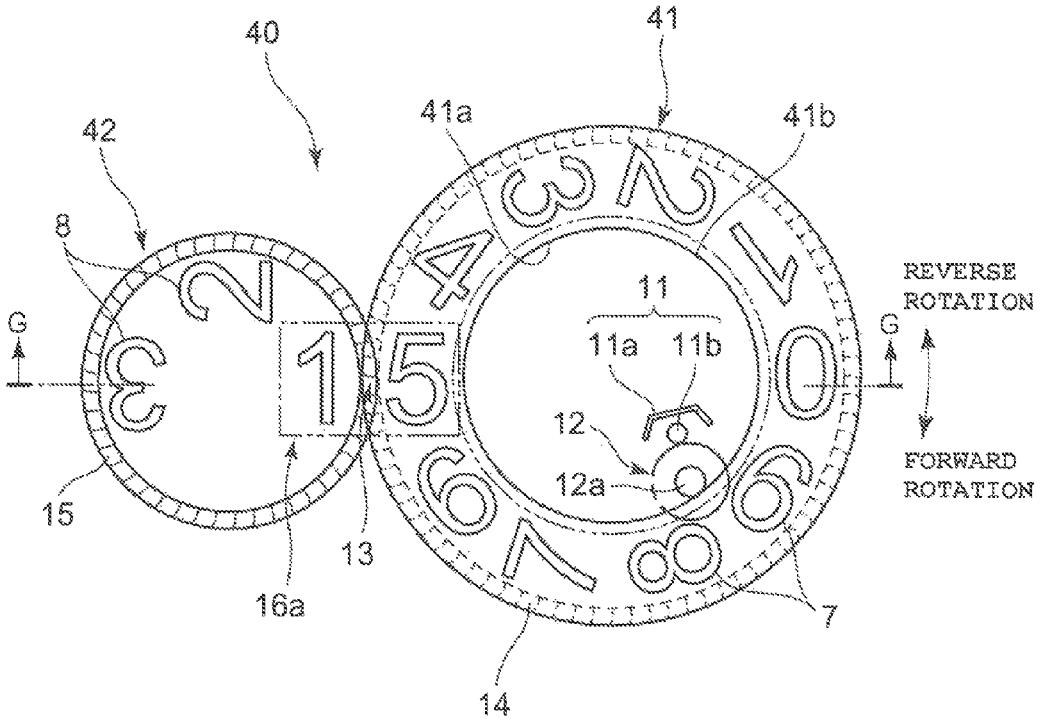
FIG. 16 is an enlarged front view of main sections of a calendar mechanism section of a second embodiment where the present invention is applied to an electronic wristwatch.
Figure 17:
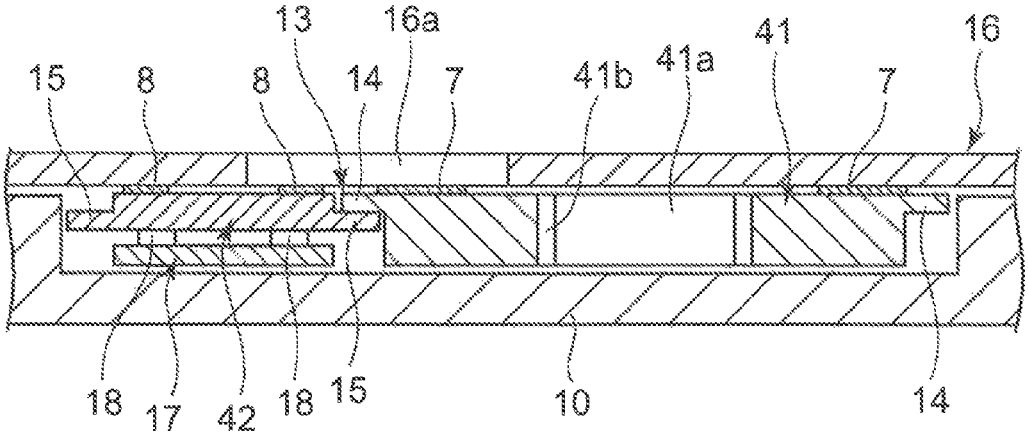
FIG. 17 is an enlarged cross-sectional view of main sections of the calendar mechanism section shown in FIG. 16, taken along line G-G.

In other words, the first display wheel 41 is formed into a ring shape where a circular hole 41*a* is provided in the center portion of the first display wheel 41, as shown in FIG. 16. The second display wheel 42 is formed into a circular shape placed adjacent to the outer peripheral portion of the first display wheel 41. The first display wheel 41 and the second display wheel 42 are rotatably placed on the housing 10 of the timepiece module 2, as shown in FIG. 17.

In this structure, the rotation of the calendar stepper motor 11 is transmitted to the first display wheel 41 via the transmitting wheel 12, whereby the first display wheel 41 is rotated in the forward direction and the reverse direction, as shown in FIG. 16 *e*. In other words, inner teeth 41*b* are circularly provided in the inner peripheral portion of the circular hole 41*a* of the first display wheel 41. As in the case of the first embodiment, the calendar stepper motor 11 includes the stator 11*a* around which a coil is wound, and the rotor 11*b* that is rotated by the magnetic field generated in the stator 11*a*. The rotor 11*b* rotates in the forward direction and the reverse direction.

The calendar stepper motor 11 is placed corresponding to the circular hole 41*a* of the first display wheel 41, as shown in FIG. 16. As in the case of the first embodiment, the transmitting wheel 12 is meshed and rotated with the pinion of the rotor 11*b* of the calendar stepper motor 11. The pinion 12*a* of the transmitting wheel 12 is meshed and rotated with the inner teeth 41*b* of the first display wheel 41. As a result, the first display wheel 41 is rotated in the forward direction and the reverse direction by the calendar stepper motor 11.

Figure 18A:
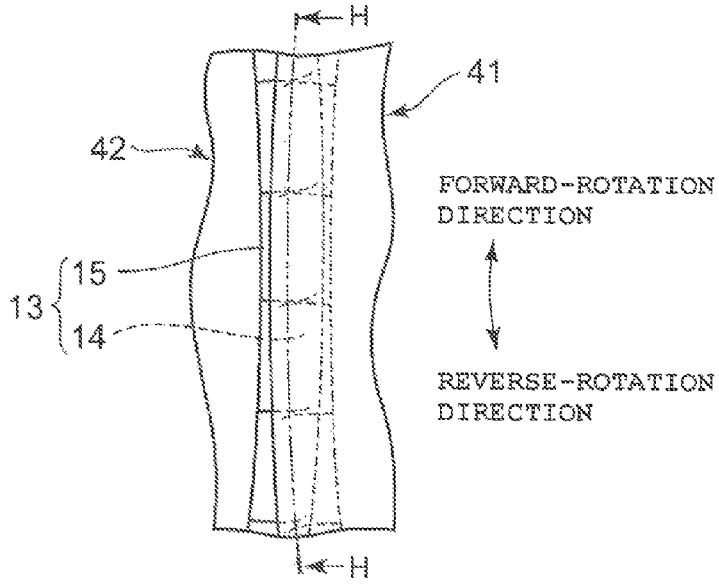

In addition, as in the case of the first embodiment, the first display wheel 41 and the second display wheel 42 include the rotating section 13 that rotates only the first display wheel 41 in the forward direction when the first display wheel 41 is rotated in the forward direction, and that rotates the second display wheel 42 in the reverse direction together with the first display wheel 41 when the first display wheel 41 is rotated in the reverse direction. The rotating section 13 has the first clutch teeth 14 that are provided in the outer peripheral portion of the first display wheel 41, and the second clutch teeth 15 that are provided in the outer peripheral portion of the second display wheel 42 and meshed with the first clutch teeth 14, as shown in FIG. 18A and FIG. 18B.

The first clutch teeth 14 and the second clutch teeth 15 are coupled with each other in the up/down direction, as shown in FIG. 17. In other words, the first clutch teeth 14 are provided in the upper outer peripheral portion of the first display wheel 41 such that the first clutch teeth 14 project outwards. The second clutch teeth 15 are provided in the lower outer peripheral portion of the second display wheel 42 such that the second clutch teeth 15 project outwards. As a result, the first clutch teeth 14 are placed on the upper side of the second clutch teeth 15 such that the first clutch teeth 14 are coupled with the second clutch teeth 15 thereon, as in the case of the first embodiment.

Figure 18B:
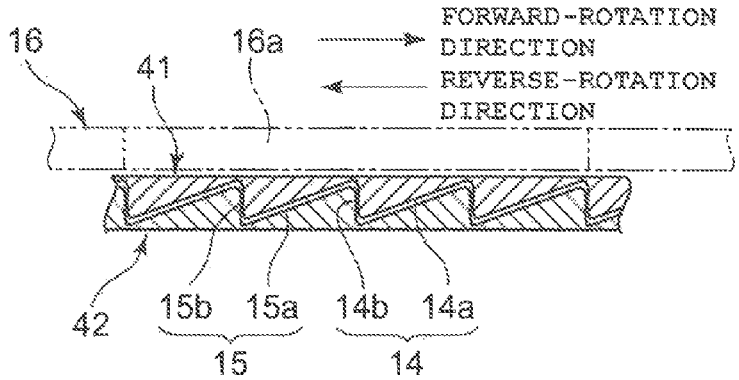
Figure 18C:
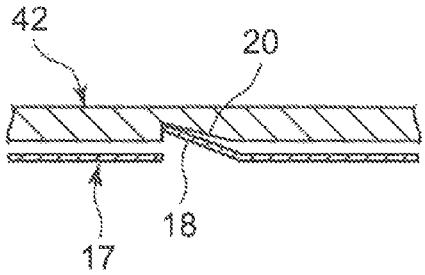

In this structure as well, the first clutch teeth 14 have sliding surfaces 14*a* and pressing surfaces 14*b*, as shown in FIG. 18B. The sliding surface 14*a* is gently inclined upward to the forward-rotation direction (clockwise direction) of the first display wheel 41. The pressing surface 14*b* is provided at a substantially right angle or at an acute angle in the end portion of the sliding surface 14*a* positioned in the reverse-rotation direction (counter-clockwise direction) of the first display wheel 41. In a similar manner, the second clutch teeth 15 have sliding surfaces 15*a* and pressing surfaces 15*b*. The sliding surface 15*a* is gently inclined upward to the forward-rotation direction of the first display wheel 41. The pressing surface 15*b* is provided at a substantially right angle or at an acute angle in the end portion of the sliding surface 15*a* positioned in the reverse-rotation direction of the first display wheel 41.

Figure 19A:
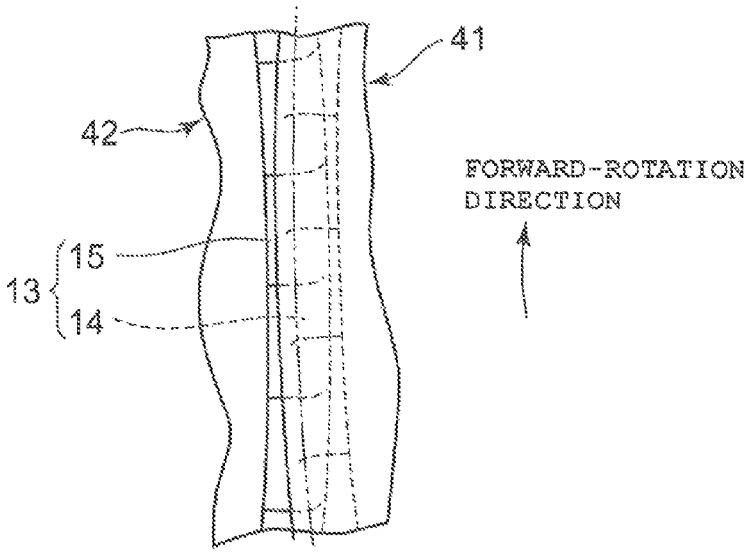
Figure 19B:
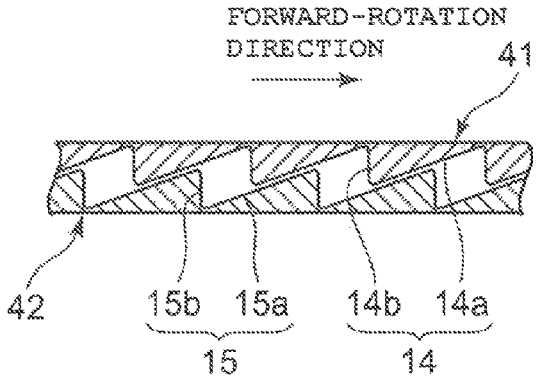

Accordingly, when the first display wheel 41 rotates in the forward direction (clockwise direction in FIG. 16) the sliding surfaces 14*a* of the first clutch teeth 14 and the sliding surfaces 15*a* of the second clutch teeth 15 slide against each other, whereby the first clutch teeth 14 and the second clutch teeth 15 become unmeshed, as shown in FIG. 19B. As a result, the rotating section 13 rotates only the first display wheel 41 in the forward direction.

Figure 20A:
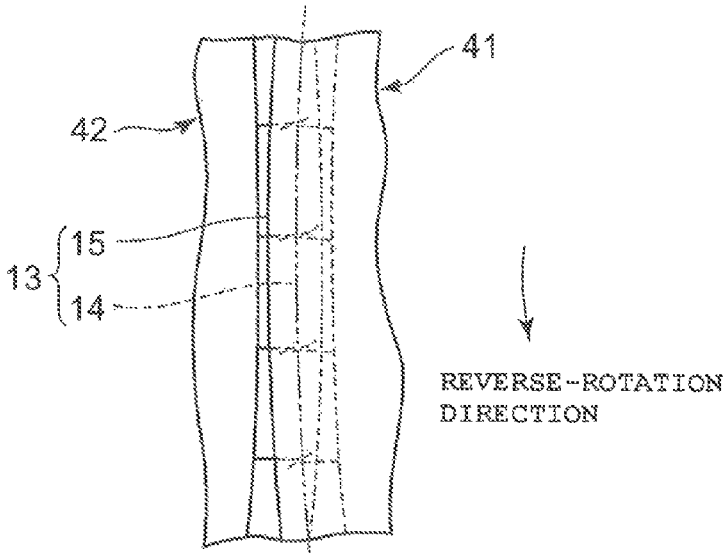
Figure 20B:
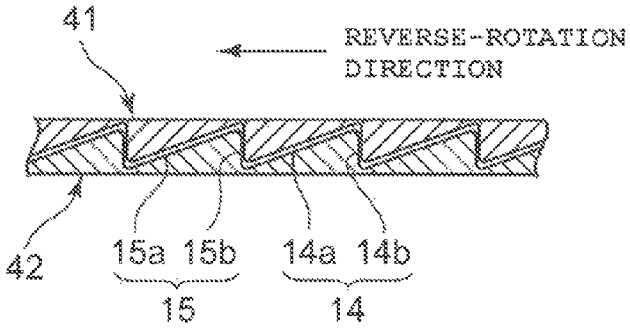

Whereas, when the first display wheel 41 rotates in the reverse direction (counter-clockwise direction in FIG. 16), the pressing surfaces 14*b* of the first clutch teeth 14 and the pressing surfaces 15*b* of the second clutch teeth 15 come in contact with and press against each other, as shown in FIG. 20B. As a result, the rotating section 13 rotates the second display wheel 42 in the reverse direction together with the first display wheel 41 in a state where the first clutch teeth 14 and the second clutch teeth 15 are meshed.

In this structure as well, the dial 16 is placed above the first display wheel 41 and the second display wheel 42, as shown in FIG. 17. The dial 16 is provided with the display window section 16*a* on a predetermined position, where one of the first date display sections 7 and one of the second date display sections 8 correspond to the display window section 16*a*, as shown in FIG. 16. Accordingly, the first clutch teeth 14 and the second clutch teeth 15 are respectively formed into a predetermined length into which the length of the display window section 16*a* in the rotation direction of the dial 16 is equally divided, such as about ¼ of the length of the display window section 16*a*.

In other words, the first clutch teeth 14 and the second clutch teeth 15 are formed such that the length of each tooth (pitch) in the rotation direction of the first display wheel 41 is a predetermined length into which the length of the display window section 16*a* in the rotation direction is equally divided, such as about ¼ of the length of the display window section 16*a*, as shown in FIG. 18B. As a result, a predetermined number of the first clutch teeth 14 and the second clutch teeth 15, e.g. four teeth, are respectively placed corresponding to the display window section 16*a*.

On the other hand, the brake member 17 is placed between the second display wheel 42 and the housing 10 of the timepiece module 2, as in the case of the first embodiment. The brake member 17 is formed into a disk shape that is substantially the same size as the second display wheel 42, as in the case of the first embodiment. The brake member 17 is fixed onto the housing 10, as in the case of the first embodiment. The brake member 17 is provided with the plurality of flat spring sections 18 that resiliently lift the second display wheel 42 upward and resiliently press the second clutch teeth 15 against the first clutch teeth 14.

Figure 19C:
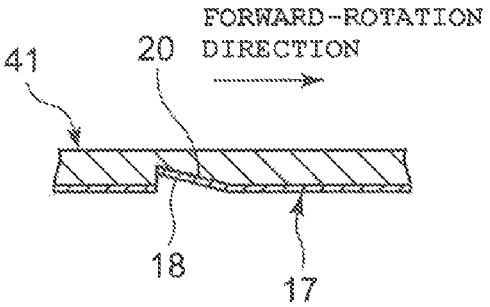

Accordingly, the brake member 17 is configured as follows when the first display wheel 41 rotates in the forward direction, the tip portions of the flat spring sections 18 relatively move along the sloped surfaces 20*a* of the sloped recessing sections 20 of the second display wheel 42 in response to the rotation of the second display wheel 42, thereby coming in contact with and being locked by the contact surfaces 20*b* of the sloped recessing sections 20. As a result, the rotation of the second display wheel 42 is prevented, as shown in FIG. 19A, FIG. 19B, and FIG. 19C.

In addition, the brake member 17 is configured as follows in the state where the rotation of the second display wheel 42 is prevented by the flat spring sections 18, the sliding surfaces 14*a* of the first clutch teeth 14 and the sliding surfaces 15*a* of the second clutch teeth 15 slide against each other in response to the forward rotation of the first display wheel 5. When the first clutch teeth 14 and the second clutch teeth 15 become unmeshed, the flat spring sections 18 are pressed downward by the second display wheel 42. As a result, the flat spring sections 18 are resiliently deformed in the up/down direction, and the first clutch teeth 14 and the second clutch teeth 15 becomes sequentially unmeshed, as shown in FIG. 19A, FIG. 19B, and FIG. 19C.

Furthermore, the brake member 17 is configured as follows when the first display wheel 5 rotates in the reverse direction, the tip portions of the flat spring sections 18 relatively move along the sloped surfaces 20*a* of the sloped recessing sections 20 of the second display wheel 42 in response to the rotation of the second display wheel 42, thereby disengaging from within the sloped recessing sections 20. As a result the rotation restriction on the second display wheel 42 are released and the second display wheel 42 rotates in the reverse direction together with the first display wheel 41, as shown in FIG. 20A, FIG. 20B, and FIG. 20G.

Next, the mechanism of the calendar mechanism section 40 will be described.

First, in the case that today is not the end of the month and the second digit of the date will not change on the following day, when the time reaches 23:59:50, the calendar stepper motor 11 is rotated in the forward direction and then the first display wheel 41 is rotated in the forward direction by an amount equivalent to one day of the date, such as by four teeth of the first clutch teeth 14. As a result, a numeral of the first date display sections 7, which is provided on the first display wheel 41 and stands for the first digit, corresponding to the display window section 16*a* of the dial 16 is changed and updated. At this time, the second display wheel 42 does not rotate even when the first display wheel 41 rotates.

In other words, when the first display wheel 41 rotates in the forward direction, the tip portions of the flat spring sections 16 of the brake member 17 come in contact with the contact surfaces 20*b* of the sloped recessing sections 20 of the second display wheel 42, and the rotation of the second display wheel 42 is prevented, as in the case of the first embodiment. Therefore, the sliding surfaces 14*a* of the first clutch teeth 14 of the first display wheel 41 and the sliding surfaces 15*a* of the second clutch teeth 15 of the second display wheel 42 slide against each other, and the first clutch teeth 14 and the second clutch teeth 15 becomes unmeshed.

At this time, the first clutch teeth 14 and the second clutch teeth 15 becomes sequentially unmeshed while the flat spring sections 18 of the brake member 17 are pressed downward and resiliently deformed by the second display wheel 42. As a result, the first display wheel 41 rotates, and a numeral of the first date display sections 7, which stands for the first digit of the date, corresponding to the display window section 16*a* of the dial 16 is changed and updated. At this time, only the first display wheel 41 rotates in the forward direction, whereby a numeral of the second date display sections 8, which is provided on the second display wheel 42 and stands for the second digit of the date, maintains its current state.

Figure 20C:
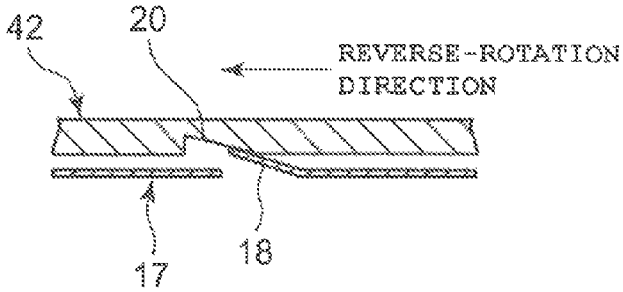

In the case that the second digit of the date changes on the following day, when the time reaches 23:59:50, the calendar stepper motor 11 is rotated in the reverse direction. And then. The first display wheel 41 is rotated in the reverse direction by an amount equivalent to an interval among the second date display sections 8 provided on the second display wheel 42, such as by 14 teeth of the first clutch teeth 14. As a result, the second display wheel 42 is rotated, whereby a numeral of the second date display sections 8 for the second digit is changed. In other words, when the first display wheel 41 rotates in the reverse direction, the tip portions of the flat spring sections 18 of the brake member 17 relatively move along the sloped surfaces 20*a* of the sloped recessing sections 20 of the second display wheel 42, thereby being disengaged from the sloped recessing sections 20. As a result, the rotation restriction on the second display wheel 42 is released, as shown in FIG. 20C.

Therefore, the pressing surfaces 14*b* of the first clutch teeth 14 of the first display wheel 41 and the pressing surfaces 15*b* of the second clutch teeth 15 of the second display wheel 42 come in contact with each other, and the first clutch teeth 14 and the second clutch teeth 15 become meshed, as shown in FIG. 20B. In this state, the second display wheel 42 rotates in the reverse direction together with the first display wheel 41. At this time, the first display wheel 41 rotates in the reverse direction by a predetermined angle, such as 90 degrees, and whereby a numeral of the first date display sections 7, which stands for the first digit, corresponding to the display window section 16*a* of the dial 16 is reversed, such as by three days earlier. In addition, the second display wheel 42 rotates together with the first display wheel 41, and a numeral of the second date display sections 8, which stands for the second digit, corresponding to the display window section 16*a* of the dial 16 is forwarded by an interval among the second date display sections 8

In this state, the first display wheel 41 has been rotated in the reverse direction by a predetermined angle, such as 90 degrees, and a numeral of the first date display sections 7 standing for the first digit has been reversed, such as by almost three days earlier. Accordingly, by that the calendar stepper motor 11 is rotated in the forward rotation, the first display wheel 41 is rotated in the forward rotation by the same amount as the first display wheel 41 was rotated in the reverse rotation, and is then further rotated in the forward direction by an amount equivalent to one day, such as four teeth of the first clutch teeth 14. At this time, only the first display wheel 41 is rotated in the forward direction, and a numeral of the second date display sections 8, which is provided on the second display wheel 42 and stands for the second digit of the date, maintains its current state. As a result, a numeral of the first date display sections 7 and a numeral of the second date display section 8 corresponding to the display window section 16*a* of the dial 16 are respectively changed and updated, where the numeral of the first date display sections 7 is provided on the first display wheel 41 and stands for the first digit, and the numeral of the second date display section 8 is provided on the second display wheel 42 and stands for the second digit on.

Whereas, in the case that today is the end of the month, when the time reaches 23:59:50, the calendar stepper motor 11 is rotated in the reverse direction. And then, the first display wheel 41 is rotated in the reverse direction, and the second display wheel 42 is rotated by the reverse rotation of the first display wheel 42. As a result, a numeral of the second date display sections 8, which is provided on the second display wheel 42 and stands for the second digit, corresponding to the display window section 16*a* of the dial 16 is changed. At this time, the first display wheel 41 is rotated in the reverse direction and whereby the second display wheel 42 is rotated such that a section representing "0" among the second date display sections 8, i.e. a blank section intermediately located between "3" (30th) and "1" (10th), corresponds to the display window section 16*a* of the dial 16.

For example, when today is February 29th (leap year) as in the case of the first embodiment shown in FIG. 15A, the second display wheel 42 is rotated by the reverse rotation of the first display wheel 41 and whereby a numeral of the second date display sections 8, which is provided on the second display wheel 42 and stands for the second digit, corresponding to the display window section 16*a* of the dial 16 (i.e. "2" (20th)) changes to the blank section, as shown in FIG. 15B. At this time, the first display wheel 41 rotates in the reverse direction by 180 degrees, and "4" of the first date display sections 7, which is provided on the first display wheel 41 and stands for the first digit, corresponds to the display window section 16*a* of the dial 16.

Then, when the numeral of the second date display sections 8, which is provided on the second display wheel 42 and stands for the second digit, is changed, the calendar stepper motor 11 is rotated in the forward direction. Accordingly, the first display wheel 41 is rotated in the forward direction by 180 degrees and is then further rotated in the forward direction by an amount equivalent to the number of days required to update a numeral of the first date display sections 7, such as by eight teeth of the first clutch teeth 14. At this time, the first display wheel 41 has been rotated in the reverse direction by 180 degrees. Accordingly, the first display wheel 41 is rotated in the forward direction by the same amount as the first display wheel 41 was rotated in the reverse rotation, and is then further rotated by an amount equivalent to the number of days required to update a numeral of the first date display sections 7, such as by eight teeth of the first clutch teeth 14.

In an example shown in FIG. 15B, "4" of the first date display sections 7, which is provided on the first display wheel 41 and stands for the first digit, corresponds to the display window section 16*a* of the dial 16. When the first display wheel 41 is rotated in the forward direction by 180 degrees, "4" of the first date display sections 7 standing for the first digit changes to "9". And then, the first display wheel 41 is further rotated in the forward direction by an amount equivalent to two days such as by eight teeth of the first clutch teeth 14. At this time, "9" of the first date display sections 7, which stands for the first digit corresponding to the display window section 16*a* of the dial 16, changes via "0" to "1" by the forward rotation of the first display wheel 41, as shown in FIG. 15C.

Therefore, "1" of the first date display sections 7 for the first digit corresponds to the display window section 16*a* of the dial 16, and whereby the date is changed and updated. At this time, only the first display wheel 41 rotates in the forward direction, and a numeral of the second date display sections 8, which is provided on the second display wheel 42 and stands for the second digit of the date, remains the blank section. Therefore, the date corresponding to the display window section 16*a* of the dial 16 becomes "1"

As described above, in the calendar mechanism section 40 of the display device of an electronic wristwatch, the calendar stepper motor 11, which is the driving section, is rotated in the forward direction and whereby the first display wheel 41 is rotated in the forward direction. As a result, a numeral of the first date display sections 7 can be changed and updated, in addition, the rotating section 13 enables only the first display wheel 41 to rotate in the forward direction, and a numeral of the second date display sections 8 provided on the second display wheel 42 can maintain its current state, as in the case of the first embodiment.

Whereas, in the calendar mechanism section 40, when the calendar stepper motor 11 is rotated in the reverse direction and whereby the first display wheel 41 is rotated in the reverse direction. As a result, the rotating section 13 enables the second display wheel 42 to rotate in the reverse direction together with the first display wheel 41, and a numeral of the second date display sections 8 provided on the second display wheel 42 can be changed and updated by the rotation of the second display wheel 42, as in the case of the first embodiment.

Therefore, the above-described calendar mechanism section 40 is also a simple structure that merely has the rotating section 13. Furthermore, by the forward rotation and the reverse rotation of the single calendar stepper motor 11, the respective numerals of the first date display sections 7 and the second date display sections 8 can be easily and appropriately changed as in the case of the first embodiment. In addition, date display can be about three times as large as existing date displays because the first date display section 7 is provided on the first display wheel 41 and the second date display section 8 is provided on the second display wheel 42, as in the case of the first embodiment. As a result, visibility of date display can be improved.

In this structure, the first display wheel 41 is formed into a ring shape (a circular shape) and the first clutch teeth 14 are circularly provided in the outer peripheral portion of the first display wheel 41. The second display wheel 42 is formed into a circular shape and placed adjacent to the outer peripheral portion of the first display wheel 41. The second clutch teeth 15 are provided in the outer peripheral portion of the second display wheel 42, where the second clutch teeth 15 are circularly coupled and meshed with the first clutch teeth 14. As a result the first display wheel 41 and the second display wheel 42 can be separately mounted to the housing 10 of the timepiece module 2. Therefore, assembly operability can be improved.

(Third Embodiment)

Next, a third embodiment in which the present invention has been applied to an electronic wristwatch will be described with reference to FIG. 21 to FIG. 24A and FIG. 24B. In this structure, sections that are the same as those in the first embodiment shown in FIG. 1 to FIG. 15A, FIG. 15B, and FIG. 15C are given the same reference numerals.

Figure 21:
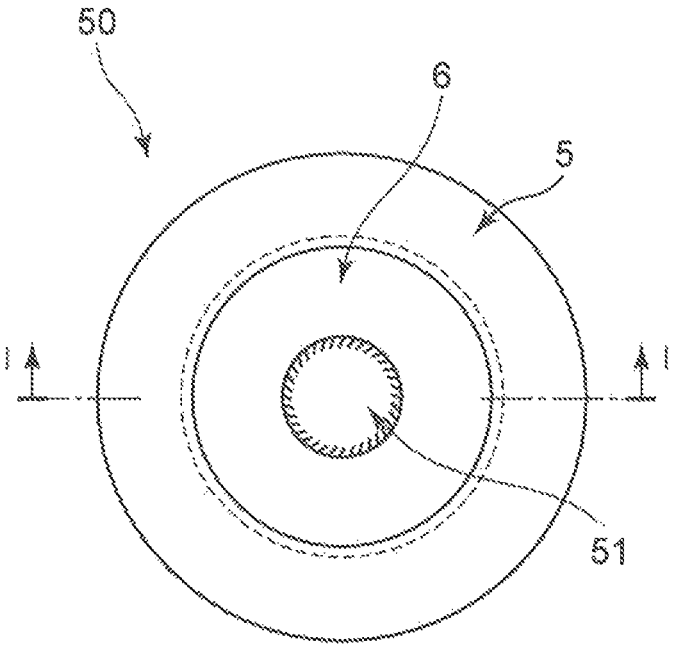
FIG. 21 is an enlarged front view of main sections of a calendar mechanism section of a third embodiment where the present invention is applied to an electronic wristwatch.

In a calendar mechanism section 50 of the electronic wristwatch, a brake member 51 in the third embodiment that applies a brake on the first display wheel 5 and the second display wheel 6 have a different configuration from that in the first embodiment, as shown in FIG. 21. Other sections have substantially similar configurations to those in the first embodiment.

Figure 22:
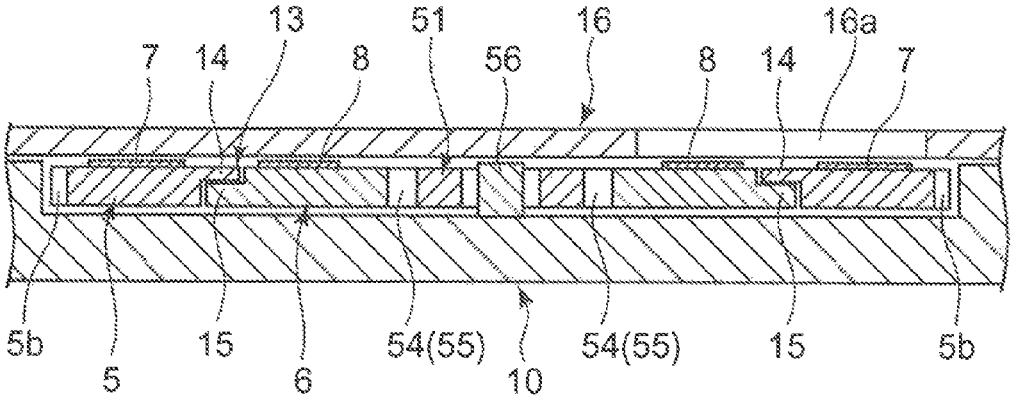
FIG. 22 is an enlarged cross-sectional view of main sections of the calendar mechanism section shown in FIG. 21, taken along line I-I.
Figure 23:
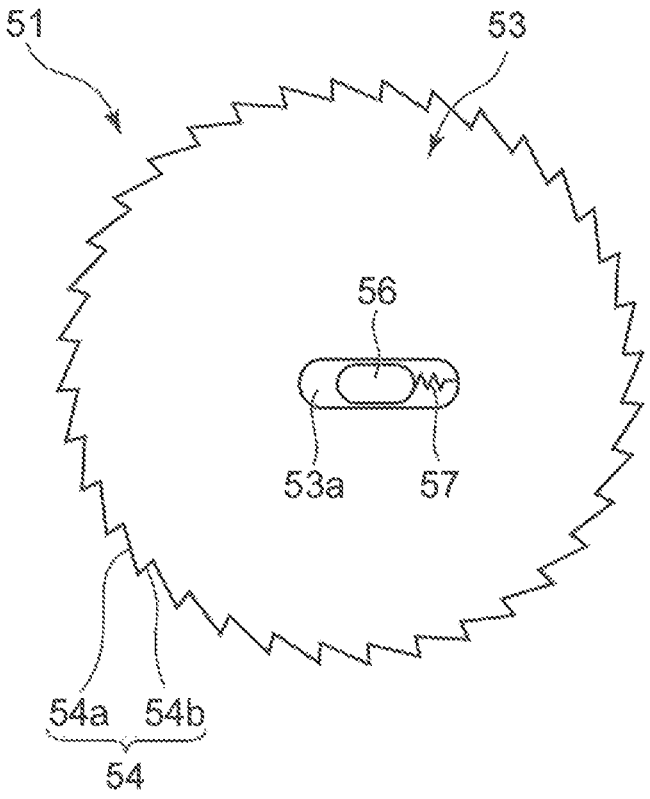
FIG. 23 is an enlarged front view of a brake member of the calendar mechanism section shown in FIG. 21.

In other words, the brake member 51 includes: a circular plate 53 (fixed plate) that is resiliently provided and can be eccentrically placed within a circular section 52 provided in the second display wheel 6; first saw teeth 54 that are provided in the outer peripheral portion of the circular plate 53; and second saw teeth 55 that are resiliently provided in the inner peripheral portion of the circular section 52 of the second display wheel 6 and engageably or disengageably engage with the first saw teeth 54, as shown in FIG. 21 to FIG. 23. In this structure, the circular plate 53 is slidably placed on the housing 10 in a non-rotating state.

Figure 24A:
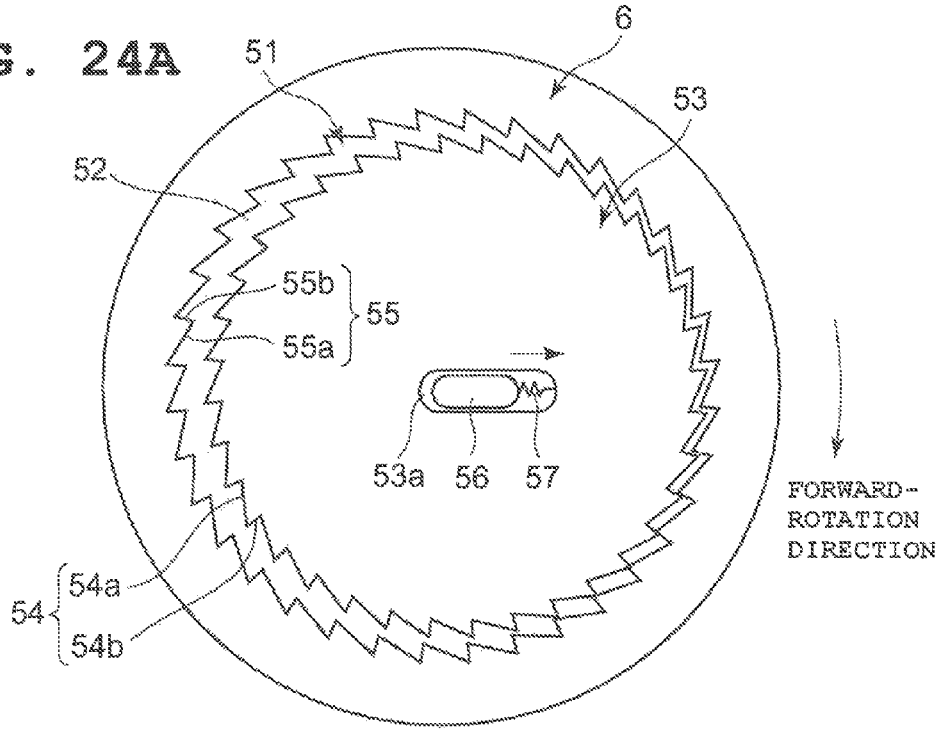
Figure 24B:
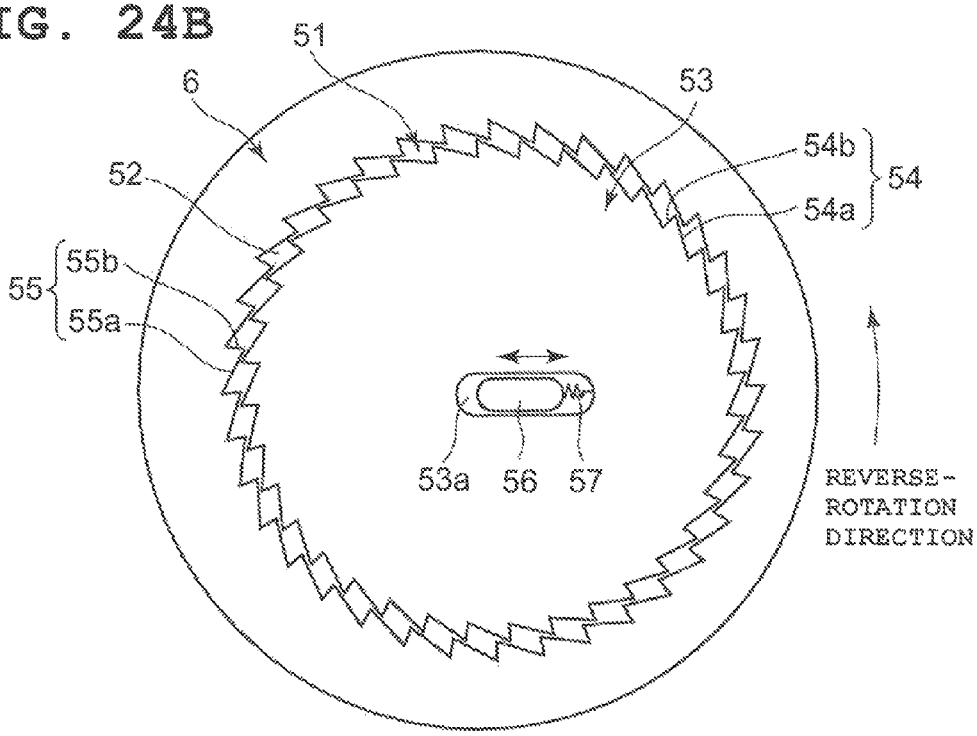

For example, an long hole 53*a* is provided in the circular plate 53, as shown in FIG. 23, and FIG. 24A and FIG. 24B. A guide shaft 56 that is provided on the housing 10, such that the cross-section of the guide shaft 56 is a non-circular shape and the guide shaft 56 is slidably inserted into the long hole 53*a* of the circular plate 53. A spring member 57 is provided between the guide shaft 56 and the long hole 53*a*, such that the spring member 57 resiliently presses a portion of the outer peripheral portion of the circular plate 53 against a portion of the circular section 52 of the second display wheel 6.

In addition, the first saw teeth 54 of the circular plate 53 have sliding surfaces 54*a* and pressing surfaces 54*b*, as shown in FIG. 23. The sliding surface 54*a* is inclined such that the sliding surface 54*a* gently projects towards the forward-rotation direction (clockwise direction in FIG. 24A) of the first display wheel 5. The pressing surface 54*b* is provided at a substantially right angle or at an acute angle in the end portion of the sliding surface 54*a* positioned in the reverse-rotation direction (counter-clockwise direction in FIG. 24B) of the first display wheel 5.

In a similar manner, the second saw teeth 55 have sliding surfaces 55*a* and pressing surfaces 55*b*, as shown in FIG. 24A and FIG. 24B. The sliding surface 55*a* is inclined such that the sliding surface 55*a* is gently squeezed towards the forward-rotation direction (clockwise direction in FIG. 24A) of the first display wheel 5. The pressing surface 55*b* is provided at a substantially right angle or at an acute angle in the end portion of the sliding surface 55*a* positioned in the reverse-rotation direction (counter-clockwise direction in FIG. 24B) of the first display wheel 5.

Accordingly, the brake member 51 is configured as follows when the first display wheel 5 rotates in the forward direction, the circular plate 53 is resiliently displaced to one side (right side in FIG. 24A), as shown in FIG. 24A. As a result, some of the pressing surfaces 54*b* of the first saw teeth 54 and some of the pressing surfaces 55*b* of the second saw teeth 55 presses against each other, and whereby some of the first saw teeth 54 and some of the second saw teeth 55 are meshed and engaged with each other. Therefore, the rotation of the second display wheel 6 is restricted, whereby only the first display wheel 5 is rotated in the forward direction.

In addition, the brake member 51 is configured as follows when the first display wheel 5 rotates in the reverse direction, the sliding surfaces 54*a* of the first saw teeth 54 and the sliding surfaces 55*a* of the second saw teeth 55 slide against each other while the circular plate 53 is resiliently displaced between both sides (right and left sides in FIG. 24B), and whereby the first saw teeth 54 and the second saw teeth 55 become sequentially unmeshed. Therefore, the second display wheel 6 is rotated in the reverse direction together with the first display wheel 5

As described above, the calendar mechanism section 50 of the electronic wristwatch in the third embodiment can achieve the same operation effect as those in the first embodiment. In addition, the brake member 51 is included that applies a brake on the rotation of the second display wheel 6. As a result, the rotation of the second display wheel 6 is restricted when the first display wheel 5 rotates in the forward direction, and the rotation restriction on the second display wheel is released when the first display wheel 5 rotates in the reverse direction. Accordingly, the second display wheel 6 can be idled and rotated by the forward rotation and the reverse rotation of the first display wheel 5, as in the case of the first embodiment. Therefore, operation reliability of the second display wheel 6 can be improved.

In other words, in the calendar mechanism section 50, when the first display wheel 5 rotates in the forward direction, the brake member 51 can restrict the rotation of the second display wheel 6, thereby preventing the second display wheel 6 from rotating. As a result, the second display wheel 6 can be favorably idled. Whereas, when the first display wheel 5 rotates in the reverse direction, the brake member 51 can unfailingly make the first clutch teeth 14 of the first display wheel 5 and the second clutch teeth 15 of the second display wheel 6 be meshed with each other. As a result, the second display wheel 6 can be unfailingly rotated by the rotation of the first display wheel 5, as in the case of the first embodiment.

In this structure, the brake member 51 includes: a circular plate 53 that is resiliently provided and can be eccentrically placed within a circular section 52 provided in the second display wheel 6; first saw teeth 54 that are provided in the outer peripheral portion of the circular plate 53; and second saw teeth 55 that are resiliently provided in the inner peripheral portion of the circular section 52 of the second display wheel 6 and engageably or disengageably engaged with the first saw teeth 54. Therefore, when the first display wheel rotates in the forward direction, the rotation of the second display wheel 6 can be unfailingly restricted and only the display wheel 5 can be rotated in the forward direction. Whereas, when the first display wheel 5 rotates in the reverse direction, the rotation restriction on the second display wheel 6 can be reliably and favorably released.

In other words in the brake member 51, when the first display wheel 5 rotates in the forward direction, the first saw teeth 54 of the circular plate 53 can engage with the second saw teeth 55 of the second display wheel 6. As a result, the rotation of the second display wheel 6 can be unfailingly restricted. Whereas, when the first display wheel 5 rotates in the reverse direction, the first saw teeth 54 and the second saw teeth 55 can be sequentially unmeshed while the circular plate 53 is resiliently displaced. As a result, the rotation restriction on the second display wheel 6 can be unfailingly released, and the second display wheel 6 can be smoothly rotated in the reverse direction together with the first display wheel 5.

Figure 25:
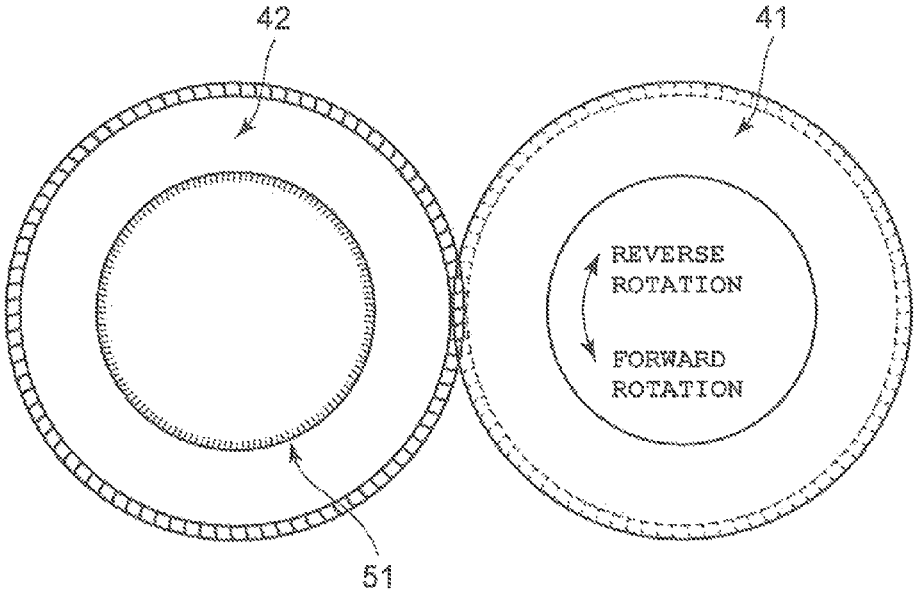
FIG. 25 is an enlarged front view of main sections of a variation example of the calendar mechanism section using the brake member of the third embodiment of the present invention.

According to the above-described third embodiment, the second display wheel 6 is rotatably placed within the circular hole 5*a* of the first display wheel 5, and the brake member 51 applies a brake on the rotation of the second display wheel 6. However, the present invention is not limited thereto. As shown in a variation example of FIG. 25, the brake member 51 may apply a brake on the rotation of the second display wheel 42 as in the case of the second embodiment where the second display wheel 42 is placed adjacent to the outer peripheral portion of the first display wheel 41.

Figure 26:
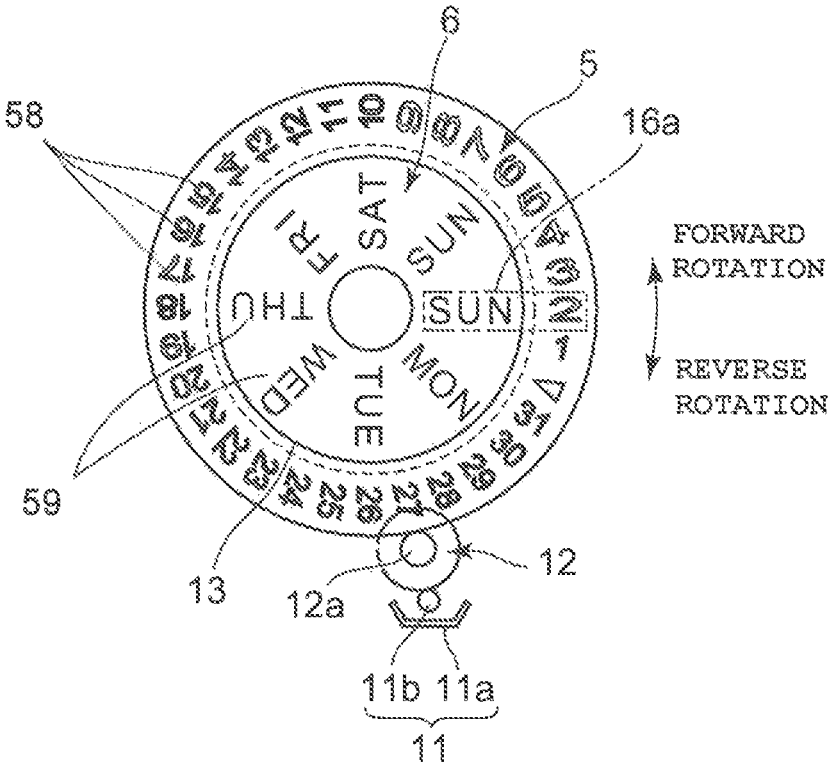
FIG. 26 is an enlarged front view of main sections of a variation example of the calendar display of the calendar mechanism section according to the first embodiment and the third embodiment of the present invention.

In addition, according to the above-described first embodiment and third embodiment, the first date display sections 7 standing for the first digit are provided on the first display wheel 5 and the second date display sections 8 standing for the second digit are provided on the second display wheel 6. However, the present invention is not limited thereto. As shown in a variation example of FIG. 26, date display sections 58 standing for the date, from the 1st to the 31st, may be provided on the first display wheel 5 as first display sections. Day-of-the-week display sections 59 standing for the days of the week, from Monday to Sunday, may be provided on the second display wheel 6 as second display sections. The present invention is not limited thereto. Month display sections standing for the month, from January to December, may be provided on the first display wheel 5, and day-of-the-week display sections standing for the days of the week, from Monday to Sunday, may be provided on the second display wheel 6 (not shown). According to the above-described configurations, the date, the day of the week, the month, and the like can be freely combined and favorably displayed.

Figure 27:
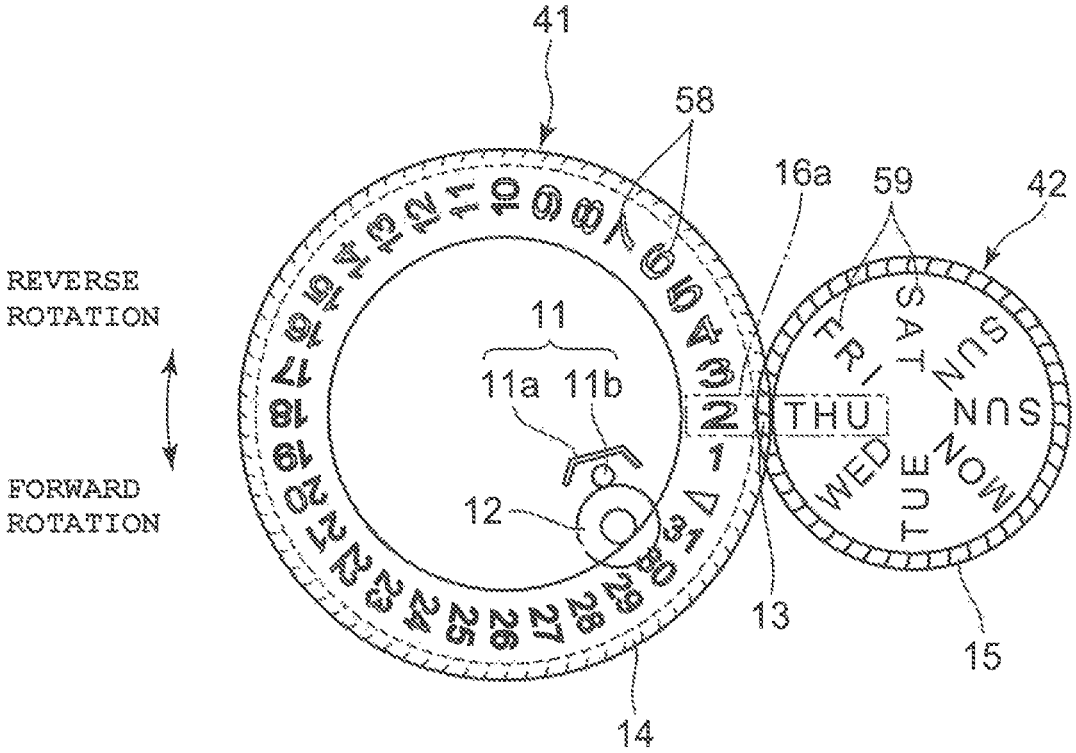
FIG. 27 is an enlarged front view of main sections of another variation example of the calendar display of the calendar mechanism section according to the second embodiment of the present invention.

Furthermore, according to the above-described second embodiment, the first date display sections 7 standing for the first digit are provided on the first display wheel 41 and the second date display sections 8 standing for the second digit are provided on the second display wheel 42. However, the present invention is not limited thereto. As shown in another variation example of FIG. 27, the date display sections 58 standing for the date, from the 1st to the 31st, may be provided on the first display wheel 41. The day-of-the-week display sections 59 standing for the days of the week, from Monday to Sunday, may be provided on the second display wheel 42. The present invention is not limited thereto. Month display sections standing for the month, from January to December, may be provided on the first display wheel 41, and day-of-the-week display sections standing for the days of the week, from Monday to Sunday, may be provided on the second display wheel 42 (not shown). In the above-described configurations, the date, the day of the week, the month, and the like can be freely combined and favorably displayed as well.

(Fourth Embodiment)

Next, a fourth embodiment in which the present invention has been applied to an electronic wristwatch will be described with reference to FIG. 28 to FIG. 31. In this structure as well, sections that are the same as those in the first embodiment shown in FIG. 1 to FIG. 15A, FIG. 15B, and FIG. 150 are given the same reference numerals.

In a calendar mechanism section 60 of the electronic wristwatch, a first display wheel 61 and a second display wheel 62 in the fourth embodiment have different configurations from those in the first embodiment, where the second display wheel 62 is coupled with the first display wheel 61 thereon. Other sections have substantially similar configurations to those in the first embodiment.

Figure 28:
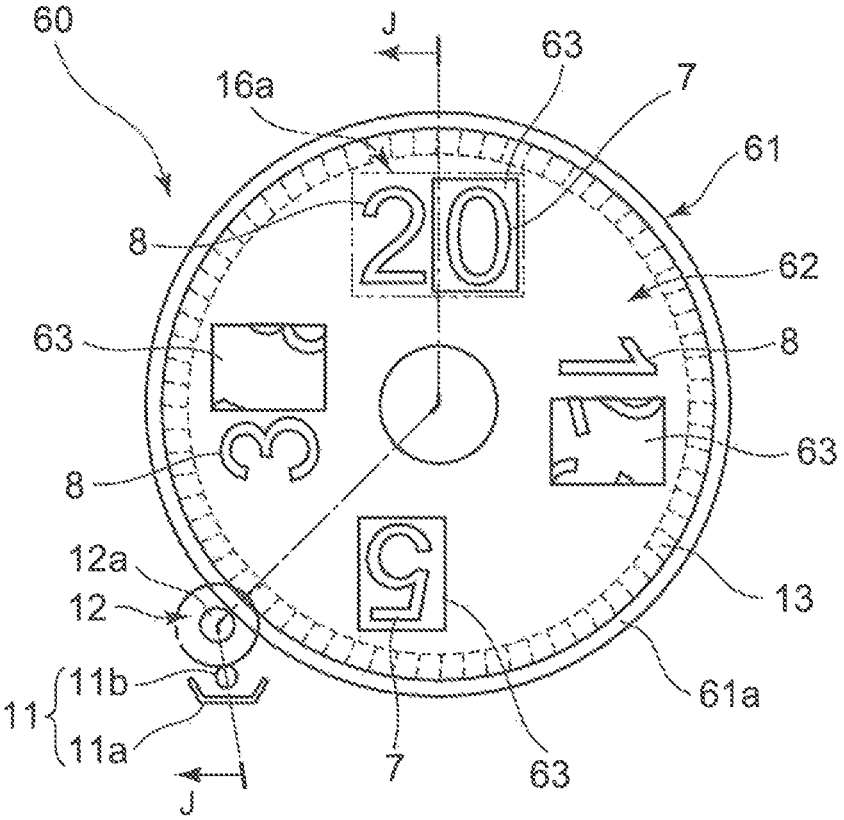
FIG. 28 is an enlarged front view of main sections of a calendar mechanism section of a fourth embodiment where the present invention is applied to an electronic wristwatch.
Figure 30:
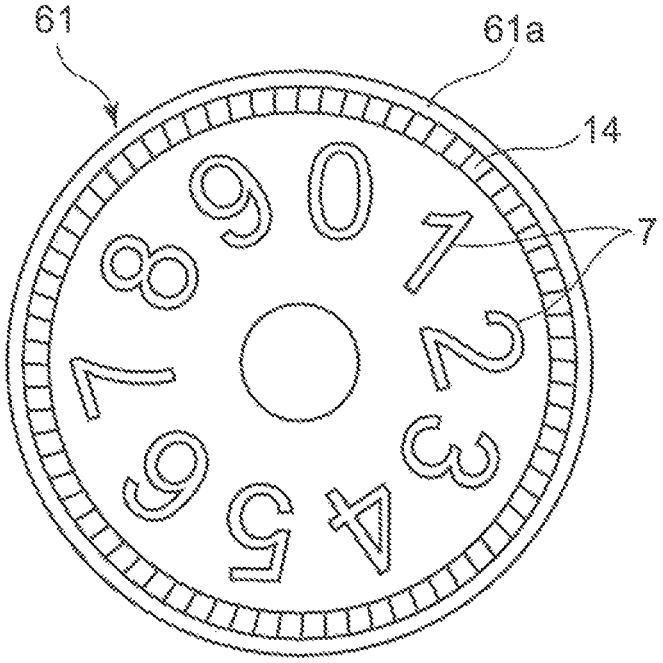
FIG. 30 is an enlarged front view of a first display wheel of the calendar mechanism section shown in FIG. 28.

The first display wheel 61 is formed into a disk shape, as shown in FIG. 28 and FIG. 30. As in the case of the first embodiment, the first date display sections 7 are circularly provided on the top surface of the first display wheel 61 where the first date display sections 7 are numerals 0 to 9 standing for the first digit of the date. The first display wheel 61 is rotated because the rotation of the calendar stepper motor 11 is transmitted to the first display wheel 61 via a transmitting wheel 12, as shown in FIG. 28 and FIG. 30. In other words, outer teeth 61*a* are provided on the outer periphery edge of the first display wheel 61 such that the outer teeth 61*a* are meshed and rotated with the pinion 12*a* of the transmitting wheel 12. The transmitting wheel 12 is rotated in the forward direction and the reverse direction by the rotor 11*b* of the calendar stepper motor 11, as in the case of the first embodiment.

Figure 29:
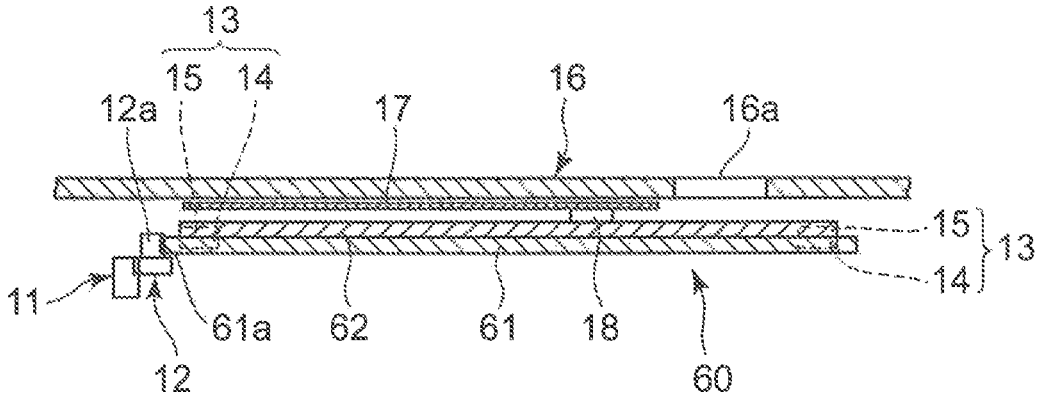
FIG. 29 is an enlarged cross-sectional view of main sections of the calendar mechanism section shown in FIG. 28, taken along time J-J.
Figure 31:
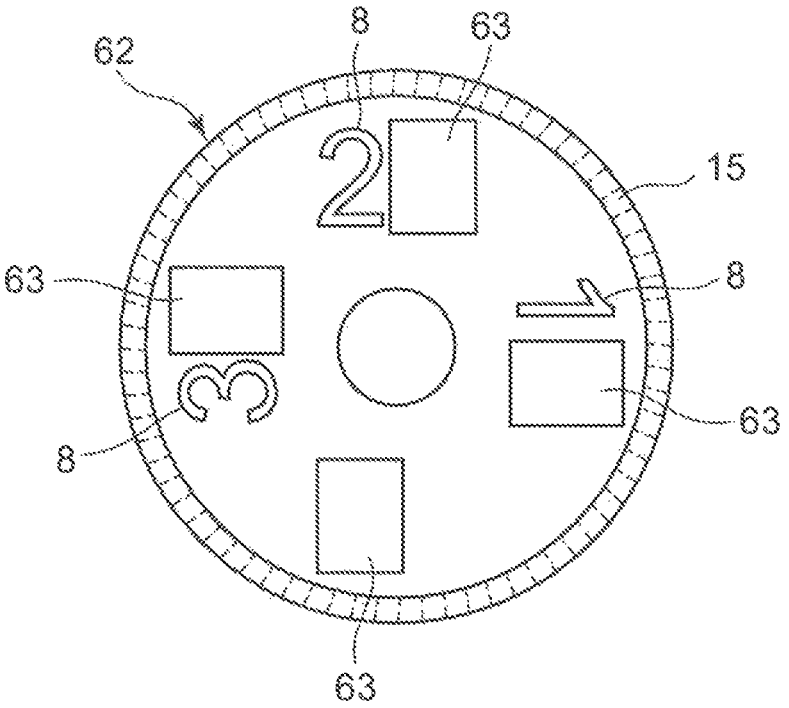
FIG. 31 is an enlarged front view of a second display wheel of the calendar mechanism section shown in FIG. 28.

The second display wheel 62 is formed into a disk shape that is slightly smaller than the outer diameter of the first display wheel 61, as shown in FIG. 28 and FIG. 29. As shown in FIG. 31, the second date display sections 8 are provided at a predetermined interval (e.g. at a 90 degree interval) on the top surface of the second display wheel 62 where the second date display sections 8 are numerals 1 to 3 standing for the second digit of the date. Display opening sections 63 are respectively provided in positions adjacent to the second date display sections 8 and a blank section located between "1" (10th) and "3", as shown in FIG. 28 and FIG. 31. There are four display opening sections 63 provided in the second display wheel 62 at a 90 degree interval where ones of the first date display sections 7 respectively correspond to the display opening sections 63.

In this structure, the dial 16 is placed above the second display wheel 62, as shown in FIG. 29. The dial 16 is provided with the display window section 16*a* positioned on the 12 o'clock side, where one of the first date display sections 7 and one of the second date display sections 8 respectively correspond to the display window section 16*a*, as shown in FIG. 28. As a result, one of the first date display sections 7 standing for the first digit appears through the display opening section 63 of the second display wheel 62, and one of the second date display section 8 standing for the second digit appears in the display window section 16*a* of the dial 16.

The first display wheel 61 and the second display wheel 62 include the rotating section 13 that rotates only the first display wheel 61 in the forward direction when the first display wheel 61 rotates in the forward direction, and rotates the second display wheel 62 in the reverse direction together with the first display wheel 61 when the first display wheel 61 rotates in the reverse direction, as shown in FIG. 28 to FIG. 31. The rotating section 13 has the first clutch teeth 14 that are provided in the outer peripheral portion of the first display wheel 61, and the second clutch teeth 15 that are provided in the outer peripheral portion of the second display wheel 62 and meshed with the first clutch teeth 14, as in the case of the first embodiment.

The first clutch teeth 14 and the second clutch teeth 15 are coupled with each other in the up/down direction, as in the case of the first embodiment. In other words, the first clutch teeth 14 are provided in the upper outer peripheral portion of the first display wheel 61. The second clutch teeth 15 are provided in the lower outer peripheral portion of the second display wheel 62. As a result, the first clutch teeth 14 are placed such that the first clutch teeth 14 are coupled with the second clutch teeth 15 thereunder.

As a result, when the first display wheel 61 rotates in the forward direction, the rotating section 13 rotates only the first display wheel 61 in the forward direction because the sliding surfaces 14*a* of the first clutch teeth 14 and the sliding surfaces 15*a* of the second clutch teeth 15 slide against each other, and the first clutch teeth 14 and the second clutch teeth 15 become unmeshed, as in the case of the first embodiment.

Whereas, when the first display wheel 61 rotates in the reverse direction, the rotating section 13 rotates the second display wheel 62 in the reverse direction together with the first display wheel 61 in a state where the first clutch teeth 14 and the second clutch teeth 15 are meshed because the pressing surfaces 14*b* of the first clutch teeth 14 and the pressing surfaces 15*b* of the second clutch teeth 15 come in contact with and press against each other, as in the case of the first embodiment.

On the other hand, the brake member 17 is placed between the second display wheel 62 and the dial 16, as shown in FIG. 29. The brake member 17 is formed into a disk shape that is substantially the same size as the second display wheel 62, and is fixed to the dial 16. The brake member 17 is provided with the plurality of flat spring sections 18 that resiliently press the second display wheel 62 downward and resiliently press the second clutch teeth 15 against the first clutch teeth 14.

The plurality of flat spring sections 18 are provided in three positions of the brake member 17, at the 3 o'clock, 6 o'clock, and 9 o'clock sides, excluding the 12 o'clock side, such that the plurality of flat spring sections 18 are inclined downward to the forward-rotation direction of the first display wheel 61, as in the case of the first embodiment. In addition, each of the plurality of flat spring sections 18 engageably or disengageably locks with each of the display opening sections 63 provided in the second display wheel 62. In this structure, a cut-out portion is provided in a portion of the brake member 17 corresponding to the 12 o'clock position such that the cut-out portion corresponds to the display window section 16*a* of the dial 16.

As a result, when the first display wheel 61 rotates in the forward direction, the tip portions of the flat spring sections 18 relatively move along within the display opening sections 63 of the second display wheel 62 in response to the rotation of the second display wheel 62, and then come in contact and lock with the edge portions of the display opening sections 63 of the second display wheel 62. Therefore, the brake member 17 prevents rotation of the second display wheel 62, as in the case of the first embodiment.

In addition, the brake member 17 is configured as follows: in the state where the rotation of the second display wheel 62 is prevented by the flat spring sections 18, the sliding surfaces 14*a* of the first clutch teeth 14 and the sliding surfaces 15*a* of the second clutch teeth 15 slide against each other in response to the forward rotation of the first display wheel 5. When the first clutch teeth 14 and the second clutch teeth 15 become unmeshed, the flat spring sections 18 are lifted upward by the second display wheel 62. As a result, the flat spring sections 18 are resiliently deformed in the up/down direction, and the first clutch teeth 14 and the second clutch teeth 15 become sequentially unmeshed, as in the case of the first embodiment.

Furthermore, the brake member 17 is configured as follows when the first display wheel 61 rotates in the reverse direction, the flat spring sections 18 relatively move along within the display window sections 53 of the second display wheel 62 while resiliently deforming in response to the rotation of the second display wheel 62, and then the tip portions of the flat spring sections 18 are disengaged from within the display opening sections 63 of the second display wheel 62. As a result, the rotation restriction on the second display wheel 62 is sequentially released, and the brake member 17 rotates the second display wheel 62 in the reverse direction together with the first display wheel 61, as in the case of the first embodiment.

As described above, the calendar mechanism section 60 of the electronic wristwatch in the fourth embodiment can achieve the same operation effect as those in the first embodiment. Furthermore, when the calendar stepper motor 11 can be rotated in the forward direction and whereby the first display wheel 61 rotated in the forward direction, a numeral of the first date display sections 7 can be changed and updated. In addition, the rotating section 13 enables the second display wheel 62 to be idled, whereby a numeral of the second date display section 8 of the second display wheel 62 can maintain its current state. Whereas, when the calendar stepper motor 11 is rotated in the reverse direction and whereby the first display wheel 61 is rotated in the reverse direction, the rotating section 13 enables the second display wheel 62 to rotate in the reverse direction together with the first display wheel 61, and a numeral of the second date display sections 8 can be changed and updated.

Therefore, the calendar mechanism section 60 is a simple structure that merely has the rotating section 13, as in the case of the first embodiment. Furthermore, by the forward rotation and the reverse rotation of just one calendar stepper motor 11, the respective numerals of the first date display sections 7 and the second date display sections 8 can be easily and appropriately changed. In addition, date display can be about three times as large as existing date displays because the first date display section 7 is provided on the first display wheel 5 and the second date display section 8 is provided on the second display wheel 6, as in the case of the first embodiment. As a result, visibility of date display can be improved.

In other words, in the calendar mechanism section 60, the display opening sections 63 are provided in the second display wheel 62 placed above the first display wheel 61 having the first date display sections 7 where ones of the first date display sections 7 respectively correspond to the display opening sections 63. In addition, one of the display opening sections 63 corresponds to the display window section 16*a* of the dial 16 placed above the second display wheel 62. As a result, the date can be displayed by a numeral of the second date display sections 8 corresponding to the display window section 16*a* of the dial 16 and a numeral of the first date display sections 7 corresponding to the display opening sections 63 of the second display wheel 62, where the second date display sections 8 are provided on the second display wheel 62 and stand for the second digit, and the first date display sections 7 are provided on the first display wheel 61 and stand for the first digit. Therefore, date display can be sufficiently larger than existing date displays, and visibility of the date display can be improved, as in the case of the first embodiment.

According to the above-described fourth embodiment, numerals 1 (10th) to 3 (30th) of the second date display sections 8 standing for the second digit are provided at a predetermined interval on the second display wheel 62, and the display opening sections 63 are respectively provided in the four positions adjacent to the numerals of the second date display sections 8 and the blank section located between "1" (10th) and "3" (30th). However, the present invention is not limited thereto. For example, the present invention may be configured as a variation example shown in FIG. 32.

Figure 32:
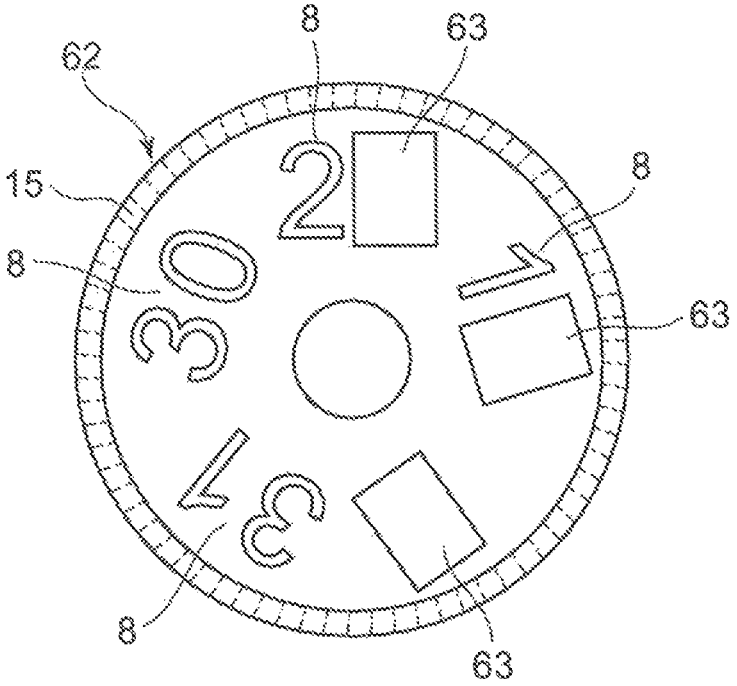
FIG. 32 is an enlarged front view of a variation example of the second display wheel according to the fourth embodiment of the present invention.

In other words, as shown in the variation example of FIG. 32, numerals "1" (10th), "2" (20th), "30" (30th), and "31" (31st) of the second date display section 8, which are provided on the second display wheel 62 and stand for the second digit, are provided at a predetermined interval. The display opening sections 63 are respectively provided in three positions adjacent to the numeral displays "1" (10th), "2" (20th) of the second date display section 8 and a blank section positioned between "1" (10th) and "31" (31st). The configuration of the above-described variation example can achieve the same operation effect as that of the fourth embodiment.

Figure 33:
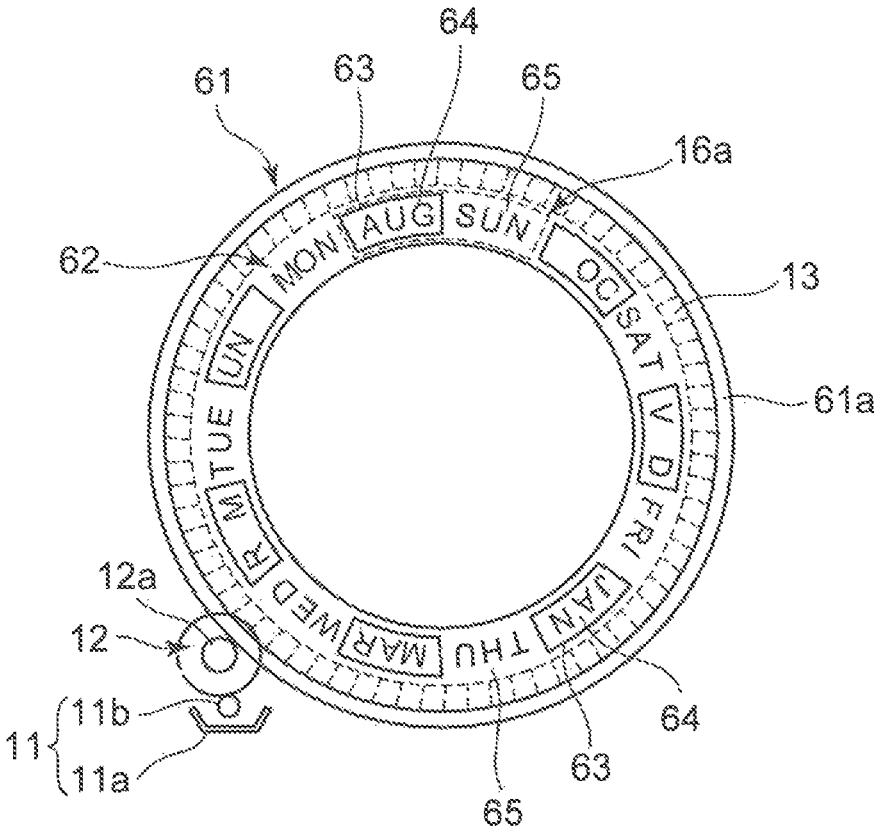
FIG. 33 is an enlarged front view of main sections in a variation example of the calendar mechanism section according to the fourth embodiment of the present invention.
Figure 34:
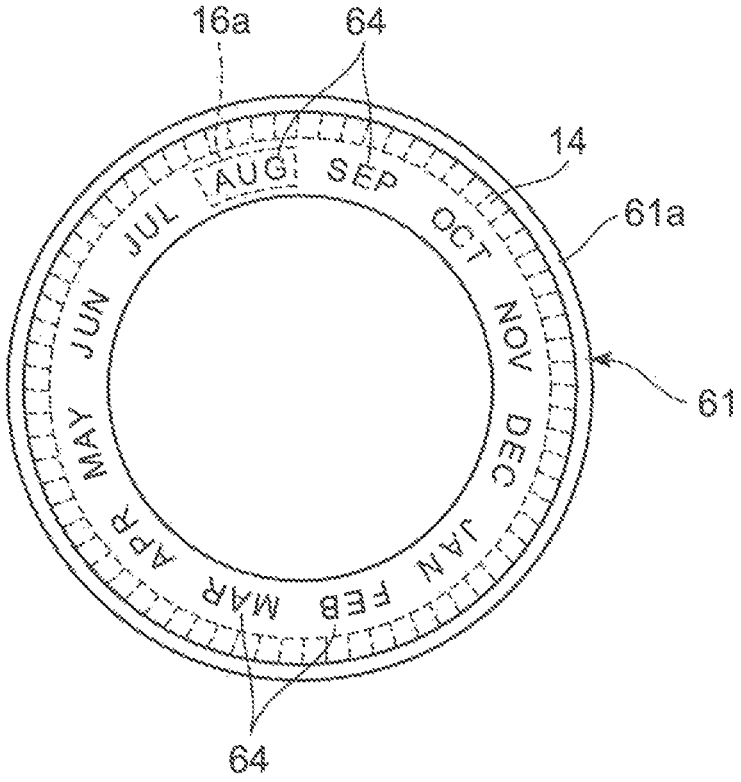
FIG. 34 is an enlarged planar view of a first display section of the calendar mechanism section shown in FIG. 33.
Figure 35:
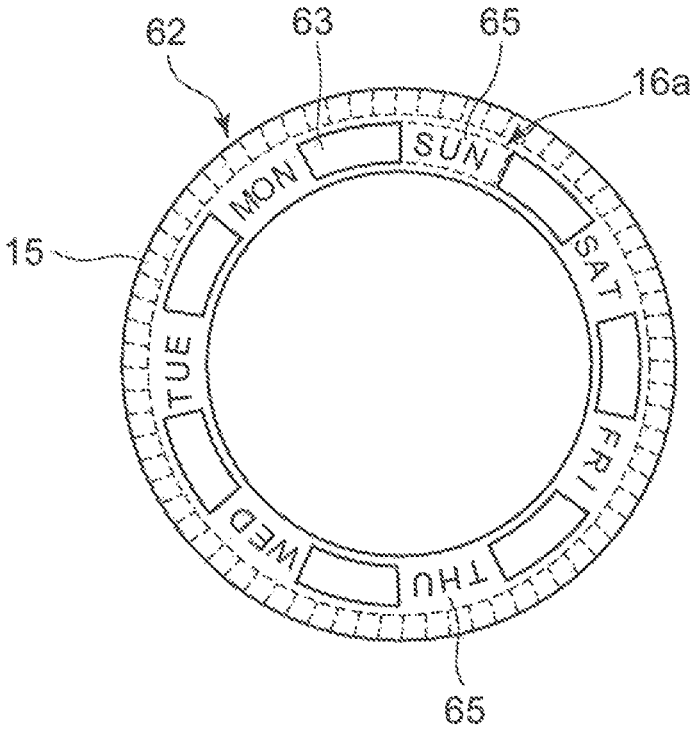
FIG. 35 is an enlarged planar view of a second display section of the calendar mechanism section shown in FIG. 33.

In addition, according to the above-described fourth embodiment, the first date display sections 7 standing for the first digit are provided on the first display wheel 61, and the second date display sections 8 standing for the second digit are provided on the second display wheel 62. However, the present invention is not limited thereto. As shown in variation examples of FIG. 33 to FIG. 35, month display sections 64 standing for the months, from January to December, may be provided on the first display wheel 61 as first display sections, and day-of-the-week display sections 65 standing for the days of the week, from Monday to Sunday, may be provided on the second display wheel 62 as second display sections. In the above-described configurations, the month and the day of the week can be favorably displayed as well as in the fourth embodiment.

In addition, the present invention is not limited to the above-described fourth embodiment and the variation examples. For example, date display sections standing for the dates, from the 1st to the 31st, may be provided on the first display wheel 61, and day-of-the-week display sections standing for the days of the week, from Monday to Sunday, may be provided on the second display wheel 62. In the above-described configuration, the date and the day of the week can be freely combined and favorably displayed as well.

Still further, according to the above-described first to fourth embodiments and variation examples, the present invention is applied to a pointer type electronic wristwatch. However, the present invention is not necessarily required to be applied to an electronic wristwatch, and can be applied to various types of electronic timepieces, such as travel clocks, alarm clocks, mantelpiece clocks, wall clocks, etc. Moreover, the present invention is not necessarily required to be applied to an electronic timepiece and may be widely applied to various types of equipment, such as a calendar apparatus, an instrument meter, etc.

Several embodiments of the present invention are described above. However, the present invention is not limited thereto and includes inventions recited in the scope of claims and scope equivalent thereto.

While the present invention has been described with reference to the preferred embodiments, it is intended that the invention be not limited by any of the details of the description therein but includes all the embodiments which fall within the scope of the appended claims.

What is claimed is:

1. A display apparatus comprising:

a first display wheel which has a first display section;

a second display wheel which has a second display section;

a driving section which rotates in a forward direction and a reverse direction, and which rotates the first display wheel in the forward direction and the reverse direction; and a rotating section which rotates only the first display wheel in the forward direction when the first display wheel is rotated in the forward direction, and which rotates the second display wheel in the reverse direction together with the first display wheel when the first display wheel is rotated in the reverse direction, wherein the first display wheel is formed into a circular shape and first clutch teeth are circularly provided on an outer peripheral portion of the first display wheel, such that the first clutch teeth are circularly provided in an upper outer peripheral portion of the first display wheel in a state where the first clutch teeth project outwards, wherein the second display wheel is formed into a circular shape and second clutch teeth are circularly provided in an outer peripheral portion of the second display wheel, such that the second clutch teeth are provided in a lower outer peripheral portion of the second display wheel in a state where the second clutch teeth project outwards, and wherein the second display wheel is placed adjacent to the outer peripheral portion of the first display wheel, and the first clutch teeth of the first display wheel and the second clutch teeth of the second display wheel are placed such that the first clutch teeth and the second clutch teeth are coupled and meshed with each other in an axial direction of the first and second display wheels.

2. The display apparatus according to claim 1, wherein the rotating section comprises the first clutch teeth and the second clutch teeth, and wherein in a state where the first clutch teeth and the second clutch teeth are coupled with each other in the axial direction of the first and second display wheels, the first clutch teeth and the second clutch teeth become unmeshed and only the first display wheel rotates in the forward direction when the first display wheel is rotated in the forward direction, and when the first display wheel is rotated in the reverse direction, the first clutch teeth and the second clutch teeth are meshed and rotated, and the second display wheel rotates in the reverse direction together with the first display wheel.

3. The display apparatus according to claim 2, wherein the first clutch teeth and the second clutch teeth respectively comprise:

sliding surfaces which are gently inclined towards the forward-rotation direction of the first display wheel; and pressing surfaces which are provided in end portions of the sliding surfaces positioned in the reverse-rotation direction of the first display wheel.

4. The display apparatus according to claim 1, further comprising a brake member which applies a brake on the rotation of the second display wheel such that the brake member restricts the rotation of the second display wheel when the first display wheel rotates in the forward direction, and such that the break member releases the rotation restriction on the second display wheel when the first display wheel rotates in the reverse direction.

5. The display apparatus according to claim 2, further comprising a brake member which applies a brake on the rotation of the second display wheel such that the brake member restricts the rotation of the second display wheel when the first display wheel rotates in the forward direction, and such that the break member releases the rotation restriction on the second display wheel when the first display wheel rotates in the reverse direction.

6. The display apparatus according to claim 3, further comprising a brake member which applies a brake on the rotation of the second display wheel such that the brake member restricts the rotation of the second display wheel when the first display wheel rotates in the forward direction, and such that the break member releases the rotation restriction on the second display wheel when the first display wheel rotates in the reverse direction.

7. The display apparatus according to claim 4, wherein the brake member has a flat spring section that is placed below the second display wheel, and that resiliently presses the second clutch teeth against the first clutch teeth, and wherein the flat spring section is inclined in a state where the flat spring section is bent obliquely upward in the reverse-rotation direction of the first display wheel, and a tip portion of the flat spring section is locked with a sloped recessing section provided in the second display wheel when the first display wheel rotates in the forward direction, and the flat spring section resiliently deforms and disengages from the sloped recessing section when the first display wheel rotates in the reverse direction.

8. The display apparatus according to claim 5, wherein the brake member has a flat spring section that is placed below the second display wheel, and that resiliently presses the second clutch teeth against the first clutch teeth, and wherein the flat spring section is inclined in a state where the flat spring section is bent obliquely upward in the reverse-rotation direction of the first display wheel, and a tip portion of the flat spring section is locked with a sloped recessing section provided in the second display wheel when the first display wheel rotates in the forward direction, and the flat spring section resiliently deforms and disengages from the sloped recessing section when the first display wheel rotates in the reverse direction.

9. The display apparatus according to claim 6, wherein the brake member has a flat spring section that is placed below the second display wheel, and that resiliently presses the second clutch teeth against the first clutch teeth, and wherein the flat spring section is inclined in a state where the flat spring section is bent obliquely upward in the reverse-rotation direction of the first display wheel, and a tip portion of the flat spring section is locked with a sloped recessing section provided in the second display wheel when the first display wheel rotates in the forward direction, and the flat spring section resiliently deforms and disengages from the sloped recessing section when the first display wheel rotates in the reverse direction.

10. The display apparatus according to claim 4, wherein the brake member comprises:

a fixed plate which is resiliently provided and can be eccentrically placed in a circular section provided in the second display wheel;

first saw teeth which are provided in an outer peripheral portion of the fixed plate; and second saw teeth which are resiliently provided in an inner peripheral portion of the circular section of the second display wheel, wherein the second saw teeth are engageably engaged or disengageably engaged with the first saw teeth, and wherein the first saw teeth engage with the second saw teeth and the rotation of the second display wheel is restricted when the first display wheel rotates in the forward direction, and the first saw teeth and the second saw teeth are sequentially disengaged when the first display wheel rotates in the reverse direction.

11. The display apparatus according to claim 5, wherein the brake member comprises:

a fixed plate which is resiliently provided and can be eccentrically placed in a circular section provided in the second display wheel;

first saw teeth which are provided in an outer peripheral portion of the fixed plate; and second saw teeth which are resiliently provided in an inner peripheral portion of the circular section of the second display wheel, wherein the second saw teeth are engageably engaged or disengageably engaged with the first saw teeth, and wherein the first saw teeth engage with the second saw teeth and the rotation of the second display wheel is restricted when the first display wheel rotates in the forward direction, and the first saw teeth and the second saw teeth are sequentially disengaged when the first display wheel rotates in the reverse direction.

12. The display apparatus according to claim 6, wherein the brake member comprises:

a fixed plate which is resiliently provided and can be eccentrically placed in a circular section provided in the second display wheel;

first saw teeth which are provided in an outer peripheral portion of the fixed plate; and second saw teeth which are resiliently provided in an inner peripheral portion of the circular section of the second display wheel, wherein the second saw teeth are engageably engaged or disengageably engaged with the first saw teeth, and wherein the first saw teeth engage with the second saw teeth and the rotation of the second display wheel is restricted when the first display wheel rotates in the forward direction, and the first saw teeth and the second saw teeth are sequentially disengaged when the first display wheel rotates in the reverse direction.

13. An electronic device comprising a device case which houses the display apparatus of claim 1.

14. An electronic device comprising a device case which houses the display apparatus of claim 2.

15. A display apparatus comprising:

a first display wheel which has a first display section;

a second display wheel which has a second display section;

a driving section which rotates in a forward direction and a reverse direction, and which rotates the first display wheel in the forward direction and the reverse direction; and a rotating section which rotates only the first display wheel in the forward direction when the first display wheel is rotated in the forward direction, and which rotates the second display wheel in the reverse direction together with the first display wheel when the first display wheel is rotated in the reverse direction; and a brake member which applies a brake on the rotation of the second display wheel such that the brake member restricts the rotation of the second display wheel when the first display wheel rotates in the forward direction, and the break member releases the rotation restriction on the second display wheel when the first display wheel rotates in the reverse direction, wherein the brake member comprises:

a fixed plate which is resiliently provided and can be eccentrically placed in a circular section provided in the second display wheel, wherein the fixed plate is provided with a slide mechanism section with a long hole for sliding the fixed plate;

first saw teeth which are provided in an outer peripheral portion of the fixed plate; and second saw teeth which are resiliently provided in an inner peripheral portion of the circular section of the second display wheel, wherein the second saw teeth are engageably engaged or disengageably engaged with the first saw teeth, and wherein the first saw teeth engage with the second saw teeth and the rotation of the second display wheel is restricted when the first display wheel rotates in the forward direction, and the first saw teeth and the second saw teeth are sequentially disengaged when the first display wheel rotates in the reverse direction.

16. The display apparatus according to claim 15, wherein the rotating section comprises:

first clutch teeth which are provided in the first display wheel; and second clutch teeth which are provided in the second display wheel and meshed with the first clutch teeth, wherein in a state where the first clutch teeth and the second clutch teeth are coupled with each other in an axial direction of the first and second display wheels, the first clutch teeth and the second clutch teeth become unmeshed and only the first display wheel rotates in the forward direction when the first display wheel is rotated in the forward direction, and when the first display wheel is rotated in the reverse direction, the first clutch teeth and the second clutch teeth are meshed and rotated, and the second display wheel rotates in the reverse direction together with the first display wheel.

17. The display apparatus according to claim 16, wherein the first clutch teeth and the second clutch teeth respectively comprise:

sliding surfaces which are gently inclined towards the forward-rotation direction of the first display wheel; and pressing surfaces which are provided in end portions of the sliding surfaces positioned in the reverse-rotation direction of the first display wheel.

18. The display apparatus according to claim 15, wherein the first display wheel is formed into a ring shape where a circular hole is provided in a center portion of the first display wheel, and first clutch teeth are circularly provided in an inner peripheral portion of the circular hole, and wherein the second display wheel is formed into a circular shape and rotatably placed within the circular hole of the first display wheel, and second clutch teeth are circularly provided in an outer peripheral portion of the second display wheel such that the second clutch teeth are coupled and meshed with the first clutch teeth.

19. An electronic device comprising a device case which houses the display apparatus of claim 15.

* * * * *

UNITED STATES PATENT AND TRADEMARK OFFICE

CERTIFICATE OF CORRECTION

PATENT NO. : 8,971,157 B2
APPLICATION NO. : 13/759705
DATED : March 3, 2015
INVENTOR(S) : Yuta Saito It is certified that error appears in the above-identified patent and that said Letters Patent is hereby corrected as shown below:

In the Claims

Column 28, Claim 4, line 6, delete “break” and insert --brake--.

Column 28, Claim 5, line 6, delete “break” and insert --brake--.

Column 28, Claim 6, line 6, delete “break” and insert --brake--.

Column 30, Claim 15, line 18, delete “break” and insert --brake--.

Signed and Sealed this
Seventh Day of July, 2015

Michelle K. Lee

Michelle K. Lee
*Director of the United States Patent and Trademark Office*